US005363298A

United States Patent [19]

Survanshi et al.

[11] Patent Number: 5,363,298

[45] Date of Patent: Nov. 8, 1994

[54] CONTROLLED RISK DECOMPRESSION METER

[75] Inventors: Shalini S. Survanshi, Potomac, Md.; Paul K. Weathersby, Gales Ferry, Conn.; Edward D. Thalmann, Olney, Md.

[73] Assignee: The United States of America as represented by the Secretary of the Navy, Washington, D.C.

[21] Appl. No.: 53,540

[22] Filed: Apr. 29, 1993

[51] Int. Cl.[5] ..... G06F 15/42

[52] U.S. Cl. ..... 364/413.31; 364/413.01; 364/413.3; 364/558; 364/569; 73/865.1

[58] Field of Search ..... 364/413.01, 413.3, 413.31, 364/558, 565, 569; 73/865.1

[56] References Cited

U.S. PATENT DOCUMENTS 4,005,282 1/1977 Jennings ..... 235/151.3
4,054,783 10/1977 Seireg et al. ..... 364/413.31
4,192,001 3/1980 Villa ..... 364/413.31
4,604,737 8/1986 Hoffman ..... 367/134
4,658,358 4/1987 Leach et al. ..... 364/413.31
4,782,338 11/1988 Barshinger ..... 340/754
4,882,678 11/1989 Hollis et al. ..... 364/413.31
4,939,647 7/1990 Clough et al. ..... 364/413.31
5,016,483 5/1991 Budinger ..... 73/865.1
5,103,685 4/1992 Wright ..... 73/865.1

*Primary Examiner*—Robert A. Weinhardt
*Assistant Examiner*—Joseph Thomas
*Attorney, Agent, or Firm*—A. David Spevack; William C. Garvert

[57] ABSTRACT

A device and method for advising an individual (diver or aviator or caisson worker) how to proceed from a high ambient pressure to a lower one in a minimum amount of time without exceeding a specified acceptable risk of suffering decompression sickness. The central algorithm is calibrated to reliably estimate instantaneous risk for the pressure exposures and functions to rapidly provide the optimum (fastest) return to lower pressure.

20 Claims, 9 Drawing Sheets

CONTROLLED RISK DECOMPRESSION METER

BACKGROUND OF THE INVENTION

1. Field of the Invention

This invention relates to a meter and method of controlling decompression risks. More specifically the invention relates to a device and method whereby at least ambient pressure, breathing gas composition, and time are sensed or simulated, processed and the resulting information, or physical control signals, are sent to a display available to the person assuming a decompression risk or debit such as a diver, aviator, space traveler or other person moving from a high ambient pressure environment to a low pressure environment. In an alternative embodiment the signals are sent to a pressure control system to allow people to decompress at a predetermined level of safety.

2. Description of the Prior Art

Decompression sickness (DCS), sometimes called bends, is a hazard to people who are subject to a reduction in atmospheric pressure. That condition occurs in divers when they return to a pressure of one (1) atmosphere (ATA) from the deep portion of their dive, in pressurized caisson workers when they leave their pressurized job site, and in aviators and astronauts who are deliberately subjected to lower than normal atmospheric pressure.

Despite much research, the detailed causes of DCS remain unknown, although most experts feel that a central role is played by expanding gas bubbles. Bubbles are possible because inert gases such as atmospheric nitrogen dissolve in body tissues up to a limit determined by atmospheric pressure, and when the pressure is reduced, the prior dissolved gas is in excess of the new atmospheric limit, termed "gas supersaturation" and has a thermodynamic tendency to form bubbles.

Because a full valid theory is lacking, all methods to avoid DCS are empirical; that is, they are based on a knowledge of which methods, by experience, tend to make DCS less likely than other methods. Nearly all methods embody a mathematical simulation of the amount of gas thought to be in body tissues, and, again by mathematical simulation, seek to limit the amount of supersaturated gas.

Since the time of Boycott et al., 1908 [1], "safe" decompression procedures have nearly all been based on putting a maximum value on the allowable ratio of gas dissolved in tissues and ambient pressure, a so-called critical supersaturation ratio. Over the years, considerable refinement in the value of the critical supersaturation ratio has occurred. Many of the more modern decompression tables or schedules (collections of rules specifying pauses, or "stops" at intermediate pressures during return to a lower pressure after exposure to a higher one to allow inert gas to be safely excreted from body tissues) use a collection of critical supersaturation ratios that depend both on the diver's current depth and on the assumed inert gas excretion rates of multiple tissues. In these cases, the supersaturation ratio is expressed as a maximum allowable value above ambient pressure at each pressure, traditionally known as maximum permissible pressure values or "M-values". The 1956 U.S. Navy Decompression Tables developed by Workman, see Workman 1965 [2], and DCIEM (Canada) 1983 air diving tables, see Nishi et al. 1983 [14] are a particularly well-known embodiment of tables based on multiple critical supersaturation values.

Decompression tables can be restrictive in some situations since they are tabulated in specific increments of pressure and time. For example, decompression tables for divers typically use depth in 10-foot increments (33 feet of seawater (fsw) approximately equals 1 ATA), and time at depth at 10-min increments. In actual use a diver must choose a table that reflects the maximum depth ever attained during a dive (no matter how brief a time actually spent at that depth) for the entire time of the dive (the time from leaving the surface, 1 ATA, to beginning decompression). For example, a diver who was at 125 feet for 25 min would use the decompression schedule of 130 feet for 30 min even though the diver's pressure exposure was not that severe and the diver did not spend a full 30 min at the maximum depth. In a more restrictive example, a diver might have spent only 5 min at 125 feet depth, another 20 rain at 35 feet (called a multilevel dive), and still need to decompress very slowly according to the 130-feet/30-minute tabulated decompression schedule when it might have been safe for him to directly return to the surface without any decompression stops.

The usefulness of a decompression meter or computer that could sense the actual pressure exposure in real-time and tailor a decompression schedule for the user's individual pressure exposure is evident. An early embodiment of an analog mechanical device for this purpose was described in U.S. Pat. No. 3,457,393 to Stubbs and Kidd issued Jul. 22, 1969. Subsequent implementations using electrical and electronic components are described in U.S. Pat. No. 3,681,585 to Todd issued Aug. 1, 1972; U.S. Pat. No. 3,992,948 to D'Antonio et al. issued November 1976; U.S. Pat. No. 4,005,282 to Jennings issued January 1977; U.S. Pat. No. 4,054,783 to Seireg et al. issued October 1977; U.S. Pat. No. 4,109,140 to Etra issued August 1978; U.S. Pat. No. 4,188,825 to Farrar issued February 1980; U.S. Pat. No. 4,192,001 to Villa issued March 1980; U.S. Pat. No. 4,586,136 to Lewis issued April 1986; U.S. Pat. No. 4,658,358 to Leach et al. issued April 1987; U.S. Pat. No. 4,782,338 to Barshinger issued. November 1988; and U.S. Pat. No. 4,882,678 to Hollis et al. issued November 1989. None of these deviate importantly in concept from the approach in the Stubbs and Kidd disclosure.

The inventions described above are all based on algorithms that produce decompression schedules, which match or approximate a set of reference tabulated decompression schedules. When used for diving these are most often those officially promulgated by the U.S. Navy in 1956. An important caution is that the reference schedules were not designed for nor tested under conditions where the gauges and computers are seemingly most valuable, that is, multilevel pressure exposures. Tests (less than 600 total) supporting the 1956 U.S. Navy Decompression Tables for diving were performed very near the limiting conditions of maximum depth for full time as tabulated in the numerous Navy decompression tables.

A further problem known to those in the art is that no decompression schedule is perfectly safe (i.e. DCS never occurs) or perfectly unsafe (i.e. DCS always occurs). Every procedure has some finite probability of leading to DCS although the chance varies greatly from procedure to procedure. It is further known, and demonstrated convincingly by Gray, et al., 1947 [3], that the identical decompression procedure can cause DCS in some people while others are unaffected, and that a person suffering DCS on one occasion can often be free of DCS on a subsequent identical exposure. This extreme human variability further limits the confidence that should be placed on procedures or devices that can be traced to tests involving relatively small numbers of test pressure exposures under quite limited conditions.

Recent advances in the art have begun to address those limitations. In 1984, Weathersby et al. [4] demonstrated how simple decompression algorithms used for diving can be optimally and objectively tied to a body of test dive data. The tie is provided by application of the Principal of Maximum Likelihood, also well known to practitioners of statistics [5,6]. Using maximum likelihood, it is possible to find the set of algorithm parameters which best describes the observed incidence of DCS in the data set. In this way, the algorithm is "calibrated" against the data set. A necessary assumption for implementation of that method is that "safety" is not a binary condition of always or never DCS, but that any procedure has some finite probability of causing DCS. Thus the method comes closer to the actual decompression observations than had been possible in using critical supersaturation methodologies which presumed a sharp boundary between ill-defined "safe" or "unsafe" procedures.

Later, the methodology was extended into more complex pressure exposures that included more complex air diving profiles (Weathersby et al., 1985a [7]). This advance used a risk function (also known as hazard or survival function) to describe the instantaneous probability of DCS occurring and from the time integral of this function computed the overall probability of DCS occurrence. These functions and the methodology for computing probability of a failure or symptom occurrence are well known to practitioners of drug efficacy trials, and of industrial machinery reliability tests [5,6]. With a mathematical algorithm based on risk functions, now objectively calibrated, it was possible to construct new decompression tables at specified levels of acceptable risk (or probability of occurrence) of DCS (Weathersby et at., 1985b [8]. This allows the user to compute decompression schedules at a level of risk to suit his particular needs, an option not previously available.

Several problems remained with probabilistic algorithms prior to the present invention. First, although overall decompression schedules could be produced at a specified risk level, information on time-course events was missing. This meant that while the overall incidence of DCS could be reliably described, times of high and low risk could not be viewed with the same degree of reliability. As will be presented further below, algorithms could only be calibrated to provide a time resolution of DCS risk of about one day when in practice it was desired to provide decompression recommendations in near real-time or at least in time scales of minutes or hours. It was necessary to find a means of objectively calibrating the probabilistic decompression algorithm with DCS information on a finer time scale. Otherwise, such an algorithm could be seriously misleading and lead inadvertently to a higher, or lower, level of risk than was deemed acceptable when used in real time or for new dives beginning less than 24 hours after a preceding dive.

Also there was no practical fast way to optimize a decompression schedule, i.e., find the one with the shortest decompression time arising from a probabilistic algorithm. As discussed in Weathersby et al., 1985b [8]), many decompression procedures are possible after a given pressure exposure, all of which may have a similar chance of causing DCS. An optimal schedule is defined as the fastest overall means of arranging decompression stop depths and times to minimize total time used for going from higher to lower pressure while still remaining below the acceptable DCS risk level. Weathersby et al. [8] shows an example where over 10,000 plausible decompression schedules could be used at the end of a moderately severe exposure each producing the same level of risk. By this invention, we have developed a means of obtaining an optimal, or near optimal, schedule with substantially less computational requirements than would be involved in evaluating thousands of possibilities.

SUMMARY OF THE INVENTION

Accordingly, an object of this invention is a device that will allow an individual undergoing a reduction in ambient pressure (decompression) to do so at no more than a specified level of risk of suffering DCS while minimizing the time it takes to complete the decompression. This risk level may be pre-determined for general use or it could be specified by the user in specific embodiments.

It is a further object of the invention to objectively calibrate the decompression algorithm used to a base of known experience of DCS, and, furthermore, to the empirical knowledge of the time ranges after beginning a pressure reduction when DCS symptoms are more likely and when they are less likely.

It is yet a further object of the invention to implement the process in an efficient computationally useful form that can provide decompression procedures in real-time as the ambient pressure and inspired gas composition changes.

Another object is to make possible the automatic adjustment of acceptable risk in systematic way.

Yet another object is to allow alternate decompression schedules for one or more secondary breathing gases.

It is still another object of the invention to generate additional information which can drive controller mechanisms or be displayed to the diver and others. This information relates to risk management, response to unplanned decompression emergencies, efficient gas management planning, medical preparations for diving contingencies, and other situations.

These and additional objects of the invention are accomplished by a device and method to provide optimum decompression advice to a user in real-time or simulated real-time on how the user can decompress with a specified risk of decompression sickness. The device includes means for sampling various signals such as pressure, time, and sometimes composition of the user's breathing gas or other physical measures. Using the sampled signals, a processor updates and stores a Pressure Exposure Index during each operating cycle of the device. The Pressure Exposure Index is a set of quantities which contain an index of the cumulative pressure-time history of the user up to that time. The processor also updates and displays optimum decompression advice based on the Pressure Exposure Index, recent optimum advice, and preset constraints. The optimum advice is based on the optimum decompression schedule that minimizes the total amount of time required for decompression without exceeding the specified level of risk. Both processor functions use a Risk Estimator module which is a mathematical model and set of previously adjusted parameters linking current and projected future pressure exposure to a body of background human pressure exposure experience. It is not always necessary to display the entire optimum decompression schedule, and in most cases all this information is unnecessary. By displaying either the time remaining at the present pressure before exceeding the preset risk upon immediate return to a lower pressure, or the total decompression time required to accomplish decompression without exceeding the preset risk, enough information is provided to allow decompression to be accomplished. Other risk-based warnings can also be included in the optimum advice.

BRIEF DESCRIPTION OF THE DRAWINGS

A more complete appreciation of the invention will be readily obtained by reference to the following Description of the Preferred Embodiments and the accompanying drawings in which like numerals in different figures represent the same structures or elements. The representations in each of the figures is diagrammatic and no attempt is made to indicate actual scales or precise ratios. Proportional relationships are shown as approximations.

DESCRIPTION OF THE PREFERRED EMBODIMENTS

Figure 1:
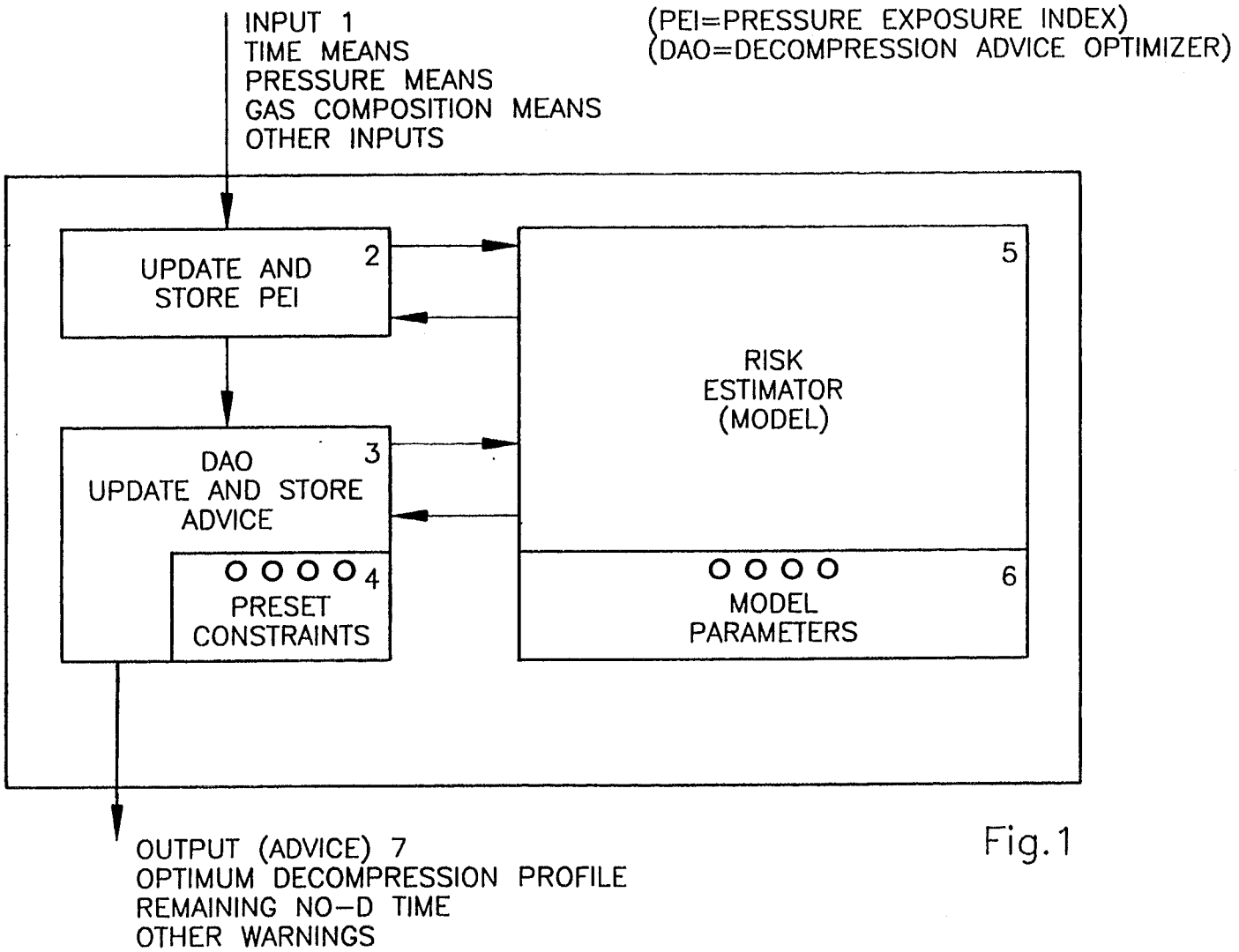
FIG. 1 is a block diagram of a device according to the present invention.

The invention is conceptually presented in FIG. 1. For simplicity of understanding, only diving terminology is used, even though the invention is equally applicable to caisson workers, pilots, astronauts and any other persons going from a higher atmospheric pressure to a lower atmospheric pressure. In its simplest form, the invention senses the time, the diver's depth (i.e. ambient pressure) and other inputs at regular time interval and updates and stores the Pressure Exposure Index (PEI) using the Risk Estimator. The PEI is a set of numeric valves that reflect the diver's complete depth-time history up to the current time. The PEI is then passed to the Decompression Advice Optimizer (DAO). The DAO constructs projected decompression schedules using preset constraints. The projected decompression schedules constructed by the DAO are then evaluated by the Risk Estimator and compared to the preset acceptable risk level $R_{acc}$. The optimum decompression schedule is the one which has the minimum total decompression time (TDT) or maximum remaining no-decompression time (NDT) and has a risk less than or equal to the $R_{acc}$. The DAO also checks for various warning conditions and displays the optimum advice.

Figure 2:
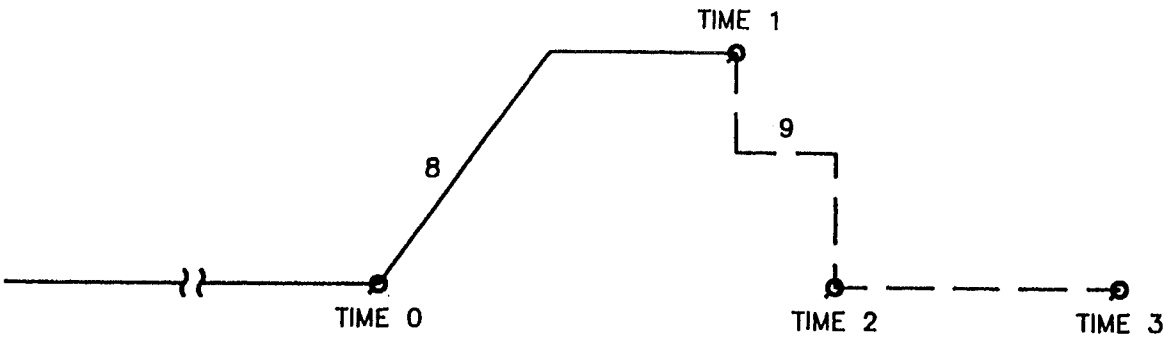
FIG. 2 is a block diagram of the Risk Estimator used in the present invention.
Figure 2:
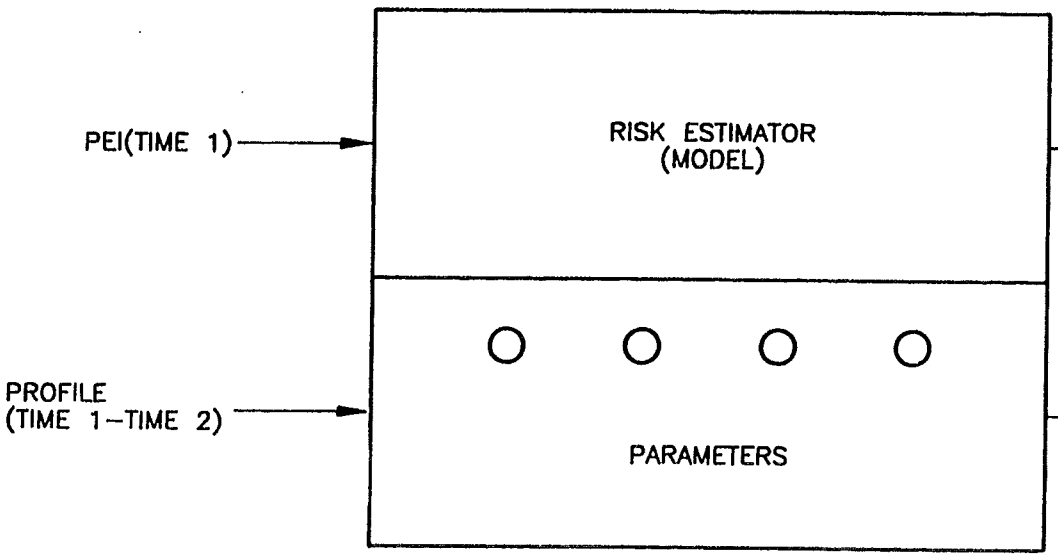

The ability of the device to give optimum decompression advice depends upon the Risk Estimator which is illustrated in FIG. 2.

Basically, the Risk Estimator accepts a PEI reflecting the dive history up to some time and a proposed depth-time profile from that time forward. It then updates the PEI to the end of the proposed depth-time profile and computes the risk, i.e., probability of decompression sickness P(DCS). In FIG. 2 the dive profile from Time0 to Time1 has already been completed and the current PEI reflects the experience up to that time. At Time1 the Risk Estimator is given the PEI up to Time1 and a proposed pressure profile from Time1 to Time2. It updates the PEI to Time2 and computes the risk accumulated between Time1 and Time2.

The success of the invention depends upon two major factors. The first is the ability to calculate the user's risk of DCS should the user follow a specific decompression path. The second is the ability to calculate an optimum decompression path in a realistically short enough time so that it can be followed by the user in real time or simulated real time. The first factor is achieved by the Risk Estimator shown in FIG. 2. The Risk Estimator has to have been scientifically calibrated against historical experience such as well documented dive data. We will first describe the Risk Estimator and its "calibration" process in detail. Later, we will describe how the invention implements the Risk Estimator to calculate the optimum advice in real time.

Risk Estimator

The Risk Estimator consists of mathematical equations which perform two functions. One is to compute and update the Pressure Exposure Index, PEI, and the second is to compute a risk of decompression sickness, P(DCS). Thus the PEI at any time point is a set of quantities called "initial conditions" that have to be known so that a new PEI and risk can be calculated from that time forward. The PEI is a name given to a set of several variables and will be explicitly defined later. These variables reflect the cumulative pressure time history to date and are used by the Risk Estimator to compute the risk, P(DCS), at any time. The equations used to calculate risk will be presented first.

Risk calculation centers around a mathematical quantity called the risk function (denoted as r), which is the instantaneous risk of the diver suffering DCS at any time. It has the character of a hazard function in probability mathematics which is well known to those in that art. The probability of a diver not suffering DCS between time $T_N$ and $T_M$ is obtained from $$P(S_{T_N-T_M}) = e^{-\int_{T_N}^{T_M} r dt} \quad (1)$$

The probability of the diver suffering DCS during the same time interval is given by $$P(DCS_{TN-TM}) = 1 - e^{-\int_{TN}^{TM} r dt} \quad (2)$$

Of course, the equations (1) and (2) are valid only if the diver has not suffered DCS up till time $T_N$. From equation (2), it is seen that overall probability of DCS occurrence (safety) is defined in terms of an integral function, so that different definitions of r that give discrepant results from moment to moment can, after integration, obtain the same overall safety prediction. Once the form of the risk function is defined, it can be integrated over any time period and equation (2) can be used to compute the risk of DCS occurring during that time period. The specific values used for $T_N$ and $T_M$ depends upon how one wishes to calculate the risk. This will be dealt with later.

Specific formulations of the risk function r can take on many different characteristics. The actual form of the risk function depends on the factors one feels contribute to the risk of DCS. One could suppose that DCS risk is related to the degree by which dissolved gas tension exceeds ambient pressure, or perhaps that it is related to the size of a gas bubble in the tissue. In any case, one must specify the set of equations which are assumed to best describe the risk. Some examples are presented here, other variants will occur to those skilled in the art.

Figure 3:
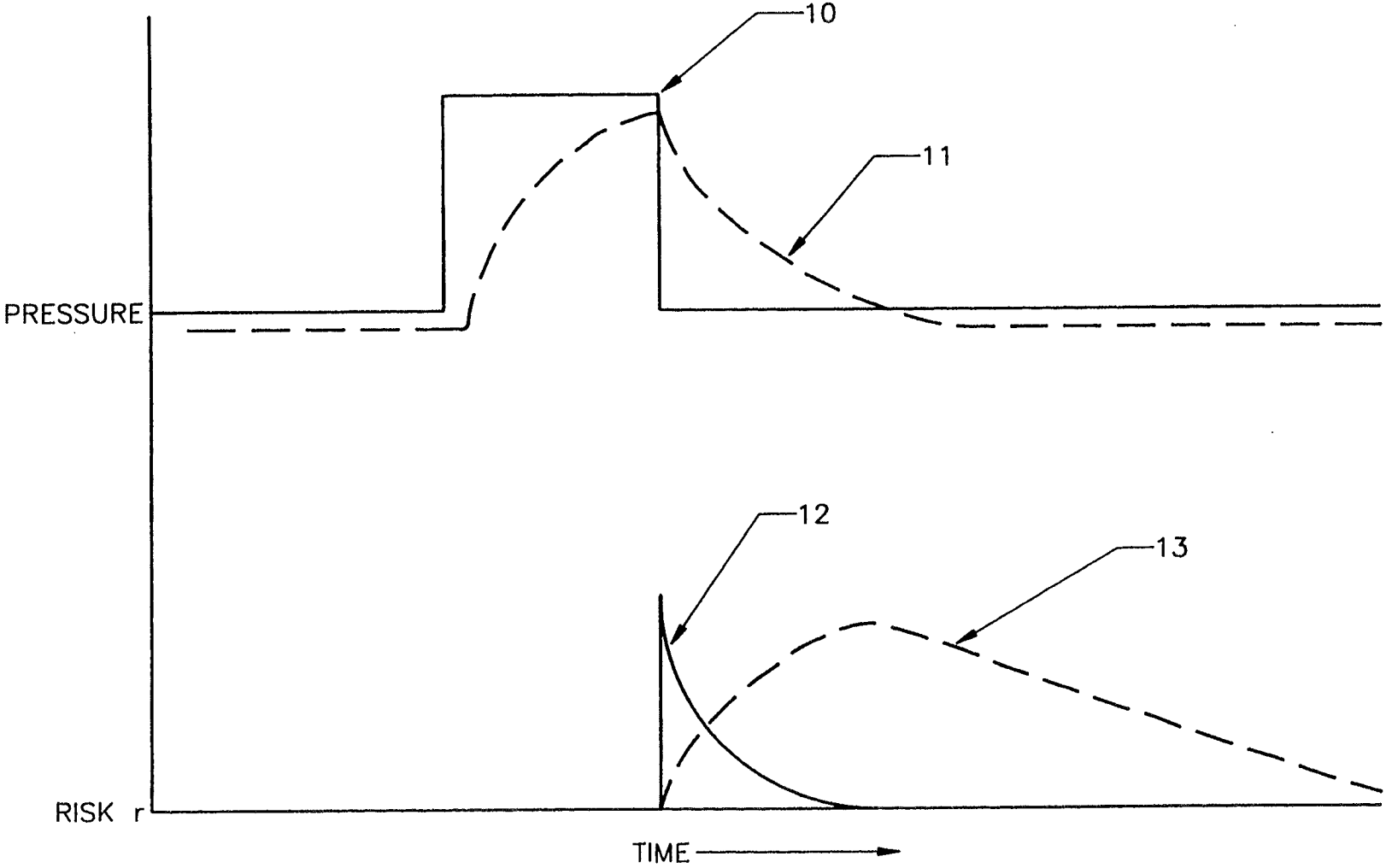
FIG. 3 is a time chart illustrating two classes of decompression risk functions for a simple pressure exposure.

FIG. 3 shows two methods of using dissolved gas tension to compute instantaneous risk. An exposure to increased ambient pressure ($P_{amb}$), trace 10, for a period of time is followed by a sudden decrease. One uses equations describing gas kinetics (which will be discussed below) to compute how the inert gas content ($P_{tis}$), trace 11, of a tissue somewhere in the body increases during the exposure, then decreases following the exposure. One of several possible mathematical expressions for r that enjoyed some success in (Weathersby, 1985a [7]) is $$r_i = A_i \frac{P_{tisi} - P_{amb} - P_{thri}}{P_{amb}}, \text{ where } r_i \geqq 0 \quad (3)$$

Here the subscript i denotes that the value is specific to a certain tissue or a compartment (there may be one or more compartments depending on the specific embodiment). $A_i$ is a scale factor parameter for each compartment; $P_{tisi}$ is calculated tissue gas partial pressure, curve 11 in FIG. 3; and $P_{amb}$ is total ambient pressure to which the diver was exposed, trace 10 in FIG. 3. $P_{thri}$ is called a compartment threshold and may be either positive or negative. The way in which the risk function described by equation (3) varies with time is shown in trace 12 of FIG. 3. The trace is zero during the time that $P_{amb}$ exceed $P_{tis}$ during the period of increased ambient pressure then rapidly rises to a maximum immediately upon completion of the ambient pressure decrease followed by a monotonic decrease.

A second class of risk functions is exemplified by curve 13 in FIG. 3. Among those that can be readily imagined is one preserving the link to supersaturation, but now asserting that the rate of change, or derivative, of the risk is proportional to relative supersaturation $$\frac{dr_i}{dt} = A_i \frac{P_{tisi} - P_{amb} - P_{thri}}{P_{amb}} \text{ where } r_i \geqq 0 \quad (4)$$

In the simple example of FIG. 3, risk curve 13 is seen to start low, then grow to maximum value at the time supersaturation becomes zero, and then declines thereafter.

Earlier implementations of decompression models or algorithms embodied quantities similar to that described by equation (3). In fact, equation (3) contains elements of supersaturation ratio. However, earlier decompression models would concern themselves only with the maximum value of the supersaturation ratio and would construct decompressions, such that this maximum value was never exceeded at any time. In our approach, the absolute value of the risk function describes only the moment-to-moment risk, and the time accumulation of this quantity is used to provide a quantitative measure of safety (now defined as the probability of DCS occurrence) using equation (2).

There has been one attempt to use the maximum value of the critical supersaturation to compute a probability of DCS occurrence (Vann, 1986 [11]). However, this method has shortcomings as discussed by Parsons et al, 1987 [12]. The most serious shortcoming is that the maximum supersaturation ratios and actual symptom occurrence, may occur at different times. This approach has no explicit way of relating these two disparate times, making it unsuitable for real-time implementation.

Those skilled in the art can easily construct other variants and combinations of these types of risk functions. Some of the variants could be based on theoretical postulates, such as simulating the growth and shrinkage of gas bubbles. However, the utility of any postulated risk function can at present only be objectively established by successful calibration with an extensive set of dive experiences.

In most cases, it is necessary to use several parallel risk calculations in order to describe an extensive set of dives. Each of the calculations proceeds similarly and is differentiated by how fast the quantity $P_{tis}$ responds to a change in inspired gas pressure. The parallel processes are sometimes termed compartments, and are conceptualized as differential rates of gas transport in different tissues of the body.

When several compartments are used, the instantaneous risk r in equation (2) is the sum of K individual compartmental risks, as given in equation (5), $$r = \sum_{i=1}^{K} r_i \quad (5)$$

Tissue Kinetics

Equations (3) and (4) use the quantity $P_{tis}$ is to compute the instantaneous risk, r. However, there are many other computational variants available to describe the rate of $P_{tis}$ changes or the so-called tissue kinetics. The most common one is pure exponential kinetics that uses the following algebraic and differential equations:

$$P_{tisi} = P_{ti} + C_V \quad (6)$$

Where $P_{ti}$ is defined by $$\frac{dP_{ti}}{dt} = \frac{1}{\alpha_i}(P_a - P_{ti}) \quad (7)$$

In the preferred embodiment $C_V$ is a constant with a value of 0.192 ATA. However, this value may also be determined during the calibration procedure in other embodiments. $P_a$ is the arterial partial pressure of the inspired inert gas (nitrogen, if air is being breathed), which is dependent on $P_{amb}$ and gas composition; and $\alpha_i$ is the time constant.

There are two common methods of controlling oxygen concentration in the breathing gas available to the divers. One is where fraction of oxygen present is kept constant, e.g. air contains 21% oxygen. The other is where a constant partial pressure of oxygen is maintained, e.g. a diving gear is set to deliver 0.7 ATA of oxygen regardless of the depth. Any other types of gas mixes can be described by combination of the two mentioned above.

If constant fraction of oxygen is maintained at $F_R$ then equation (8) is used to derive the value of $P_a$. If constant partial pressure of oxygen is maintained at $F_C$ ATA, then equation (9) is used.

$$P_a = P_{amb} - F_R(P_{amb} - C_a) \quad (8)$$

$$P_a = P_{amb} - F_C\left(\frac{P_{amb} - C_a}{P_{amb}}\right) \quad (9)$$

In the preferred embodiment $C_a$ is a constant with a value of 0.108 ATA. However, this value may also be determined during the calibration procedure in other embodiments.

The term $\alpha_i$ in equation (7) is a time constant which may be specified beforehand, or more generally can be determined in the calibration process. The decompression models used to compute the 1956 U.S. Navy Decompression Tables, and their variations, use equations (6), (7), (8) and (9) with $C_a$ and $C_V$ set to zero and seven discrete values of $\alpha$ in the range of 7.2 to 345 min to describe gas uptake and elimination in seven discrete compartments (another common expression used instead of $\alpha$ is "tissue half-time", denoted $T_{\frac{1}{2}}$, where $T_{\frac{1}{2}}=0.693\ \alpha$). If kinetic equation (7) is used to describe tissue pressure in equations (3) or (4), there will be three parameters per compartment: $A_i$, $P_{thri}$, and $\alpha_i$. The parameter values are determined during the calibration process.

A modification of purely exponential kinetics has been found useful wherein the removal of inert gas from the tissue is slowed and becomes linear (v. exponential) if decompression has caused $P_{tis}$ to exceed $P_{amb}$ by a specified amount (Thalmann, 1984 [13])

$$\frac{dP_{ti}}{dt} = \frac{1}{\alpha_i}(P_a - P_{ti}), \text{ if } P_{tisi} \leqq P_{amb} + P_{xoi} \quad (10a)$$

$$\frac{dP_{ti}}{dt} = \frac{1}{\alpha_i}[P_a - (P_{amb} + P_{xoi}) + C_V],$$

$$\text{if } P_{tisi} > P_{amb} + P_{xoi} \quad (10b)$$

Figure 4:
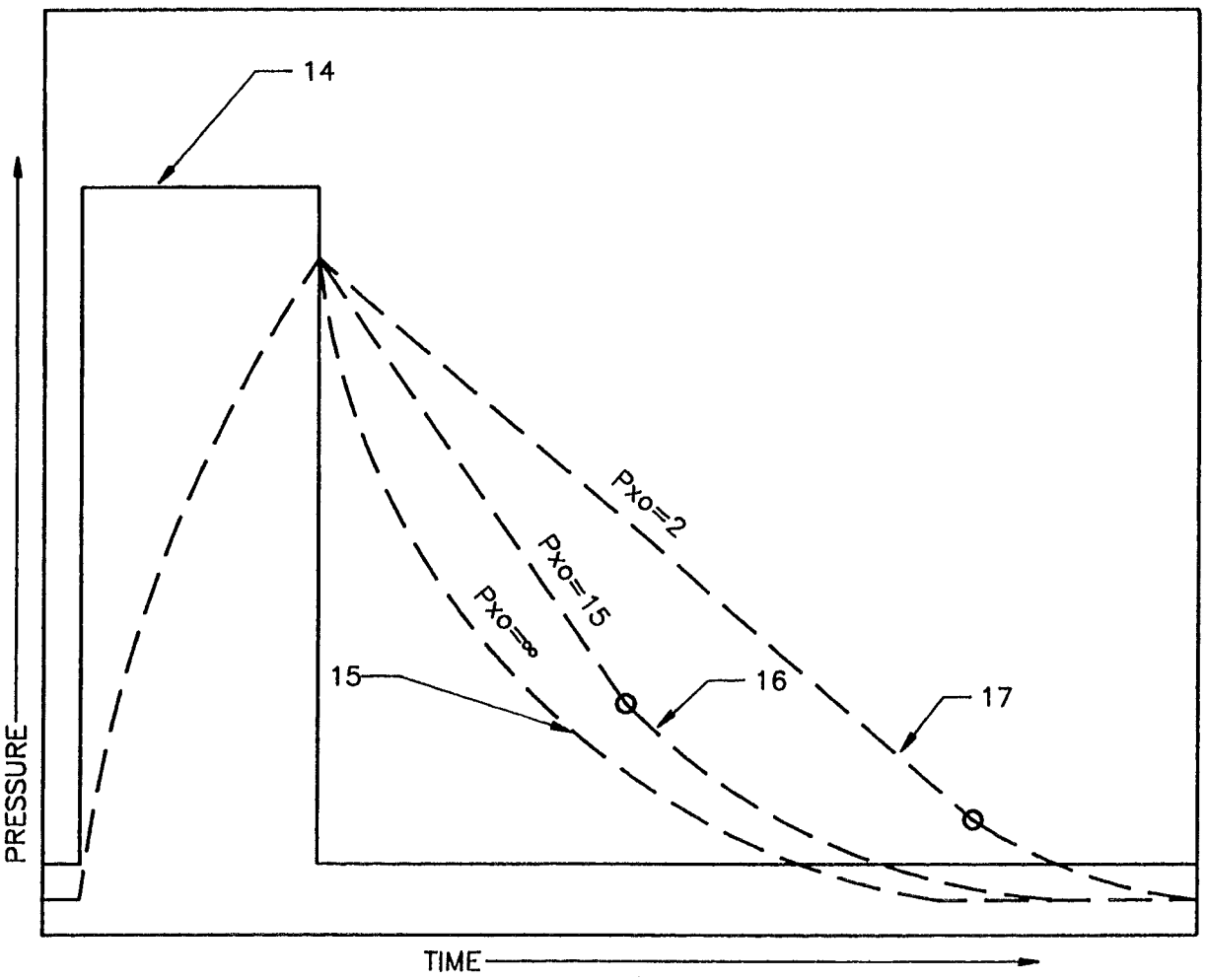
FIG. 4 is a time chart illustrating the influence of parameter $P_{xo}$ in linear-exponential kinetics when subjected to a simple step pressure exposure.

The crossover parameter, $P_{xoi}$, is the pressure at which kinetics changes. As shown in curve 15 in FIG. 4, when $P_{XO}$ has a high value, the first inequality of equation (10a) is always met and the kinetics remain purely exponential. When $P_{XO}$ has a smaller value, such as 2 to 15 fsw (feet of sea water) pressure, the kinetics inequality in equation (10b) may be met and become linear as in curves 16 and 17 of FIG. 4, since the response of equation (10b) is linear for some time following the step change decompression, trace 14. It should be noted that $P_{tisi}$ and its derivative are continuous at the crossover point. In the preferred embodiment kinetic equations (10a) and (10b) are used to describe $P_{tisi}$ in equations (3) or (4), resulting in 4 parameters per compartment: $A_i$, $P_{thri}$, $\alpha_i$, and $P_{xoi}$ and they are determined during calibration process.

Solutions to the differential equations (10a) (which is the same as equation (7)) and 10b will depend upon how $P_a$ changes. $P_a$, which is a function of $P_{amb}$, can be described as a set of linear ramp functions for a given dive profile or can be described as a set of instantaneous step functions. The integration of the instantaneous risk r has to be carried out only when the value of r is greater than zero, thus requiring determination of the points in time where r goes above or below zero (roots of equations (3) or (4) where r=0). Solutions using ramp forcing functions can be tedious while solution using step forcing functions are straightforward. Which solutions to use depends upon the dive data format and the degree of approximation desired. If the dive data is in form of ramps, one could approximate them to equivalent set of steps and use the step solution. One could also solve the differential equations numerically during the calibration process and use step solutions during the real time implementations. We used ramp solutions, as described in Parker, et al. (15), for the calibration and also for one form of the real-time implementation. We have also embodied step solutions for other real-time implementation.

In all our implementations of the invention, we have used entirely digital processors. It is also clearly possible to use analog processors for an implementation, especially for integrating equations (3), (4), (7) and (10).

What has been described above are four possible risk functions. Equation (7) and the pair of equations (10a&b) are two possible ways of computing $P_{tis}$; which can then be placed in equations (3) or (4) to compute the individual compartmental instantaneous risk. Having done this the compartmental risks are summed using equation (5), integrated over the specified time interval $T_N$, $T_M$ and the P(DCS) computed using equation (2). In fact, all four of these possibilities were examined during calibration and the best one chosen for the preferred embodiment as described in the next section. The risk functions have several parameters whose values must be determined. They are:

K=number of compartments $A_1, A_2 \ldots A_K$=risk scale factor for each compartment $\alpha_1, \alpha_2 \ldots \alpha_K$=time constant for each compartment $P_{Thr1}, P_{Thr2} \ldots P_{ThrK}$=threshold parameters for each compartment $P_{xo1}, P_{xo2} \ldots P_{xoK}$=crossover parameters for each compartment (needed only if equation 10 is used)

Once the number of compartments, K, is specified, it is a straightforward matter to write the exact equations for the four possible risk functions. Once that is done, it is then necessary to determine values for each of the three or four parameters for each compartment. This is done by calibrating the Risk Estimator against a database of actual pressure/time profiles with known outcomes.

Pressure Exposure Index (PEI)

To compute the risk during the time period $T_N$, $T_M$ using equation (2) the risk function r must be integrated over that time period. If equation (3) is used for r then the only information needed to accomplish this are the current values for $P_{tisi}$ at $T_N$ for each of the K compartments. If equation (4) is used as the risk function then the current value of $r_i$ at $T_N$ must be known in addition. The PEI consists of the set of all quantities necessary to compute the risk using equation (2), namely:

$$P_{tis1}(T_N), P_{tis2}(T_N) \ldots P_{tisK}(T_N)$$

and if equation (4) is used $$r_1(T_N), r_2(T_N) \ldots r_K(T_N)$$

The number of quantities that comprise the PEI will depend on the form of the risk function and the number of compartments. However, the PEI contains all the current values of the variables that change as the dive profile progresses, and which are necessary to compute the value of the risk integral over any future time increment.

Calibration of the Risk Estimator

The Risk Estimator was first calibrated and is described in this section. After calibration it was tested on a prospective trial as described in the next section. During the calibration process, the PEI is initialized to the values appropriate to being saturated on air on surface (diver's initial condition before start of the dive) and a pressure-time profile from a database is passed to the Risk Estimator. The estimated risk of DCS is then correlated to the actual dive outcome as to if and when the DCS occurred. The model parameters are systematically changed in such a way that the dive outcomes are most likely to occur, formally known as the maximum likelihood method.

In earlier calibration procedures, Weathersby et al. [4] and [7], we calibrated r using only binary outcomes (DCS or No-DCS) wherein a "final" outcome was known, and the actual time at which symptoms occurred was not taken into consideration. When using equation (2) to compute P(DCS), we were forced to adopt a rather late value for $T_M$ while $T_N$ was always set to zero, i.e., the beginning of the dive. Since only outcome (DCS or no DCS) was used and no information about time at which the DCS occurred was used, there could be no confidence in the time course of r, just the total integrated value. In order to get the total integrated value, the integration had to be carried out long enough so that the value of r had decreased to very near zero. In this case, $T_M$ was selected as 24 hours or longer after the test dive was complete. Now we have obtained records of test dives that have the time of occurrence of DCS known, at least approximately. Specifically, for almost every DCS case we have a time, $T_1$, when the diver was known to be completely free of DCS symptoms, and a later time, $T_2$, when the diver was known to have definitely suffered DCS. The interval between $T_1$ and $T_2$ is the period of uncertainty and varies from a few minutes to several hours depending on how suddenly the symptoms appeared and how closely the test dives were monitored. With this additional information, it is possible to calculate the probability of the joint event; that is, the condition of no DCS occurrence from 0 to $T_1$ and then suffering DCS during the $T_1$–$T_2$ interval. This probability is expressed as:

$$P(S_{0-T_1}, DCS_{T_1-T_2}) = \left(e^{-\int_0^{T_1} r dt}\right)\left(1.0 - e^{-\int_{T_1}^{T_2} r dt}\right) \quad (11)$$

The probability of no DCS ever occurring is still given by equation (1) where $T_N$ is zero and $T_M$ is 24 to 48 hours after the dive. The use of equations (1) and (11) and a collection of dive experience with known times of DCS occurrence provides the means of calibrating a probabilistic decompression model, such that the time course of r over short time intervals is objectively connected with known facts. When properly calibrated, one can have confidence that the time course of r now describes areas of high and low risk, and that reasonable estimates can be made, not only of the numbers of symptoms, but also of the time periods during which they are most likely to occur.

The calibration process uses a data base of dives of known DCS outcome to determine parameter values of the risk function, r. After specifying initial values for the parameters, they are systematically changed until a set of parameters are obtained that give the best possible description of the model to the actual data. We used modified least-squares method for nonlinear parameter estimation as described by Marquardt [9]. The measure of how well the model describes the data using a specific set of parameters is provided by the method of maximum likelihood. The fit of the model using a specific set of parameters to the data is measured by both how well it predicts the observed incidence of DCS, and by how well it predicts the time intervals during which the symptoms are most likely to occur. Indication of how well the preferred embodiment performed is given in the following section. This process is well described in Weathersby et al, (1984) [4], Weathersby et al, (1985a) [7], and Weathersby et al, (1992a) [10], which are incorporated herein by reference.

We examined all four possible combinations of the risk function r (equations (3) or (4)) and $P_{tis}$ (equations (7) or (10)) in which the probability of outcome (DCS or no DCS) was computed using equations (1) or (3). To choose the best model, we used a data base consisting of over 2,300 test dives performed in American, Canadian, and British Naval laboratories during the period 1977–1991 (Weathersby et al, 1992b [16] [this publication and the data base are available from the U.S. Navy. The dives in this data base met the criteria of having the dive profile know to a precision of ±2 feet or better, and of having sufficient on scene medical coverage to know for certain whether or not DCS occurred and, in many cases, when symptoms occurred. Data not meeting these criteria will not provide reliable calibration. They range from very deep (to 500 fsw) but short (under 2 min) tests of submarine escape equipment, through several days at 60 fsw to test long DCS treatment procedures. The later dives are referred to as "saturation dives". Over 1,000 of the tests involved breathing nitrogen-oxygen mixtures different from air; and over 400 tests had more than a single foray to depth—so called repetitive dives. During these tests, over 100 cases of DCS were recorded, and several dozen cases of marginal symptoms—minor problems deemed related to the dive and decompression but not so serious as to require recompression therapy (these marginal symptoms were scored as 0.1 case of DCS each; a discussion of marginal symptoms is available in Weathersby, et al, 1984 [4] and 1987 [17]). Nearly all of the DCS and marginal cases had time of occurrence information available.

The model that was clearly superior was the one using the risk equation (3) and the linear exponential kinetics described by equations (10a) and (10b), with three compartments. The parameter values which were optimal were:

| Parameter | Compartment 1 | 2 | 3 |
|---|---|---|---|
| Time Constant, $\alpha$ (min) | 1.47 | 50.8 | 487.6 |
| Scale, A ($min^{-1}$) | $4.3 \times 10^{-3}$ | $1.1 \times 10^{-4}$ | $1.0 \times 10^{-3}$ |
| $P_{thr}$ (fsw) | 0.00 | 0.00 | 1.75 |
| $P_{xo}$ (fsw) | $\infty$ | 1.05 | $\infty$ |

Measure or Success of Calibration

Parameter values determined by fitting the algorithm to the data set may not necessarily perform well on all subsets of the data. Measurement of how well the parameters perform are made independently. The preferred embodiment and its parameters did perform well on this extensive set of calibration data. Measures of performance are provided by the likelihood function and its statistic called the log likelihood. Comparisons among probabilistic models and their log likelihoods on a set of calibration data can be assessed by standard statistical procedures, such as the Likelihood Ratio Test. As a rule of thumb, an improvement of 7–10 log likelihood units is quite important in models with about the number of parameters involved here. Linear-exponential kinetics with the first risk function (equation (3)) achieved over 45 log likelihood units better than with the time-delayed second risk function (equation (4)). Using pure exponential kinetics, either risk function formulation was worse by over 10 log likelihood units.

A summary of how well the preferred embodiment predicted DCS incidence among the subsets of calibration data is presented here:

PERFORMANCE ON CALIBRATION DATA BY DIVE TYPE

| | Man-Dives | Number of DCS Cases Observed | Predicted |
|---|---|---|---|
| Single Air | 876 | 45.9 | 31.0–48.8 |
| Repetitive Air | 194 | 14.0 | 10.2–16.2 |
| Single non-Air | 772 | 30.8 | 24.5–37.9 |
| Repetitive non-Air | 239 | 11.0 | 11.5–17.8 |
| Saturation | 302 | 36.8 | 28.2–52.1 |
| GRAND TOTAL | 2383 | 138.5 | 105.4–172.8 |

In this summary, the test dives are divided into 5 categories according to breathing gas and whether multiple (repetitive) exposures to depth were used. Between 194 and 876 test dives fall in each category. The DCS cases observed include full DCS and marginals as 0.1 case. The final column of predicted cases is the range of expected cases when each of the tests is assessed by the preferred embodiment model and parameters, including uncertainty in the parameters themselves (range is formally assessed by propagating the parameter co-variance matrix into 95% confidence limits, according to the teachings of Ku, 1966 [18]). It is evident that both grand total cases and test dive category predictions generally overlap, and, in most cases, are centered about the actual observed incidence of DCS.

Calibration of a probabilistic algorithm by time at which DCS cases occurred is also central to this invention. The success with which the preferred embodiment predicted times of occurrence is demonstrated in the following table:

PREDICTION OF DCS OCCURRENCE BY TIME OF SYMPTOMS

| Time Category | Number of DCS Cases Observed | Predicted |
|---|---|---|
| Before Surfacing | 26.5 | 30.4 |
| Surfacing to +30 min | 12.2 | 15.2 |
| Surfacing +30 min to +2 hr | 26.0 | 27.6 |
| Surfacing +2 hr to +4 hr | 23.3 | 21.8 |
| Surfacing +4 hr to +24 hr | 20.8 | 12.0 |

To construct this table, five different time categories were constructed and all of the DCS and marginal cases allocated to these categories according to their recorded $T_1$–$T_2$ intervals. Then the total predicted P(DCS) for all single dives from the data base was summed within each time category. Substantially close agreement is seen for all categories. Inspection reveals that the final category for the latest occurrence of symptoms is underestimated by nearly 50%. This observation is acknowledged as a limitation in the preferred embodiment but one which is still an important advance over the prior art.

Prospective Testing of the Risk Estimator

Once parameter performance on retrospective calibration data was deemed adequate, performance when computing new profiles was measured. To do this the preferred embodiment model and parameters were subject to a prospective trial under the supervision of the inventors during 1991 and early 1992. Over 700 test dives were conducted at the Naval Medical Research Institute, Bethesda, Md., and the Naval Experimental Diving Unit, Panama City, Fla. (Kelleher et al. (19)), emphasizing types of dives not well represented in the calibration test set. The results follow:

| Category (Man-Dives) | Predicted Cases of DCS | Observed Cases of DCS |
|---|---|---|
| Single Air "D" (67) | 2.7 | 4 |
| Repet No-"D" Air (113) | 7.3 | 4 |
| Repet "D" Air (23) | 2.7 | 4 |
| ML Air (234) | 17.1 | 13 |
| ML Air/0.7 $PO_2$ "D" (134) | 7.2 | 6 |
| ML Air/0.7 $PO_2$ Transit (139) | 5.7 | 5 |

Here, six types of dives were selected. In the table, single dives are those where divers descend to a specific depth, remain there a specified time, then ascend to the surface according to the decompression meter display. "Repet" dives are one or more single dives separated by some period at the surface. ML denotes multilevel dives where divers spend various times at various depths during a particular exposure. "D" denotes dives where decompression stops at intermediate depths were required and No-"D" denotes dives where no decompression steps were required. Air denotes dives where air was breathed throughout, and Air/0.7 $PO_2$ denotes dives where breathing gas was switched from air to one simulating that which would be provided by an underwater breathing apparatus which fixes the oxygen partial pressure at 0.7 ATA. 0.7 $PO_2$ Transit means that the 0.7 ATA $PO_2$ gas was breathed during the shallow, constant depth transit portion of the dive between deeper segments at 60 to 100 fsw. It is evident that predictive success was achieved with this trial since in nearly all cases predicted and observed categories agreed within 4–5 DCS cases (approximately the limit of statistical precision of both prediction and limited trial size observation).

It is clear that the invention so far described has a proven capability to estimate the chance of a diver suffering DCS. Its reliability spans the range of exposure of interest to nearly all recreational divers and most military and commercial divers: pressures of up to 10 atmospheres or so for periods of several minutes out to 4 or so atmospheres for many hours or even days. The source of breathing gas can be air or any other mixture of nitrogen and oxygen.

Current Limitations of the Risk Estimator

However, there are some diving ranges where the preferred embodiment of invention is not as reliable. In the technique of in-water oxygen decompression wherein the diver breathes nearly 100% oxygen before surfacing, the actual chance of DCS may be 2 or 3 times higher than estimated in the preferred embodiment. Also in the technique of surface decompression wherein the diver deliberately leaves the water after inadequate decompression time but returns to pressure within a few minutes—and usually breathes oxygen as well—the preferred embodiment of the invention may also underpredict DCS chance by a factor of 2 or 3. Finally, the invention assesses the risk of DCS from sudden surfacing after several days at 20 fsw breathing air at about 7%. Limited test data indicate that this estimate may be too high.

An obvious tactic to address problems like those just stated is to change the calibration data set to more heavily include dives that are of special interest and repeat the calibration procedure. A prediction reliable for surface decompression, for example, could use parameters calibrated from a set of test dives rich in surface decompression.

Extension of this invention into other decompression exposures is also readily accomplished. The current preferred embodiment is mathematically capable of assessing safety of altitude decompression, caisson worker profiles, and deep sea helium-oxygen diving, among others. However, these are substantial extrapolations outside the calibration test data and cannot be presumed as reliable. Use of calibration tests under more or less similar conditions to the intended application are needed for reliability.

Real Time Implementation

Once the Risk Estimator has been calibrated, i.e., optimal parameter values have been determined, and tested it is ready to be used in the real time implementation. Central to the operation of the invention in real-time, as is true of most of the cited prior art, is the update cycle. This cycle is the sequence of operations necessary to assure an "adequate" real-time response to any changes in the diver's condition. In testing of the invention, both 5 and 10 second update cycles have been used. The cycle time will change the precision with which the actual dive profile is estimated by periodic sampling. These cycle times were chosen to investigate this effect.

Figure 5:
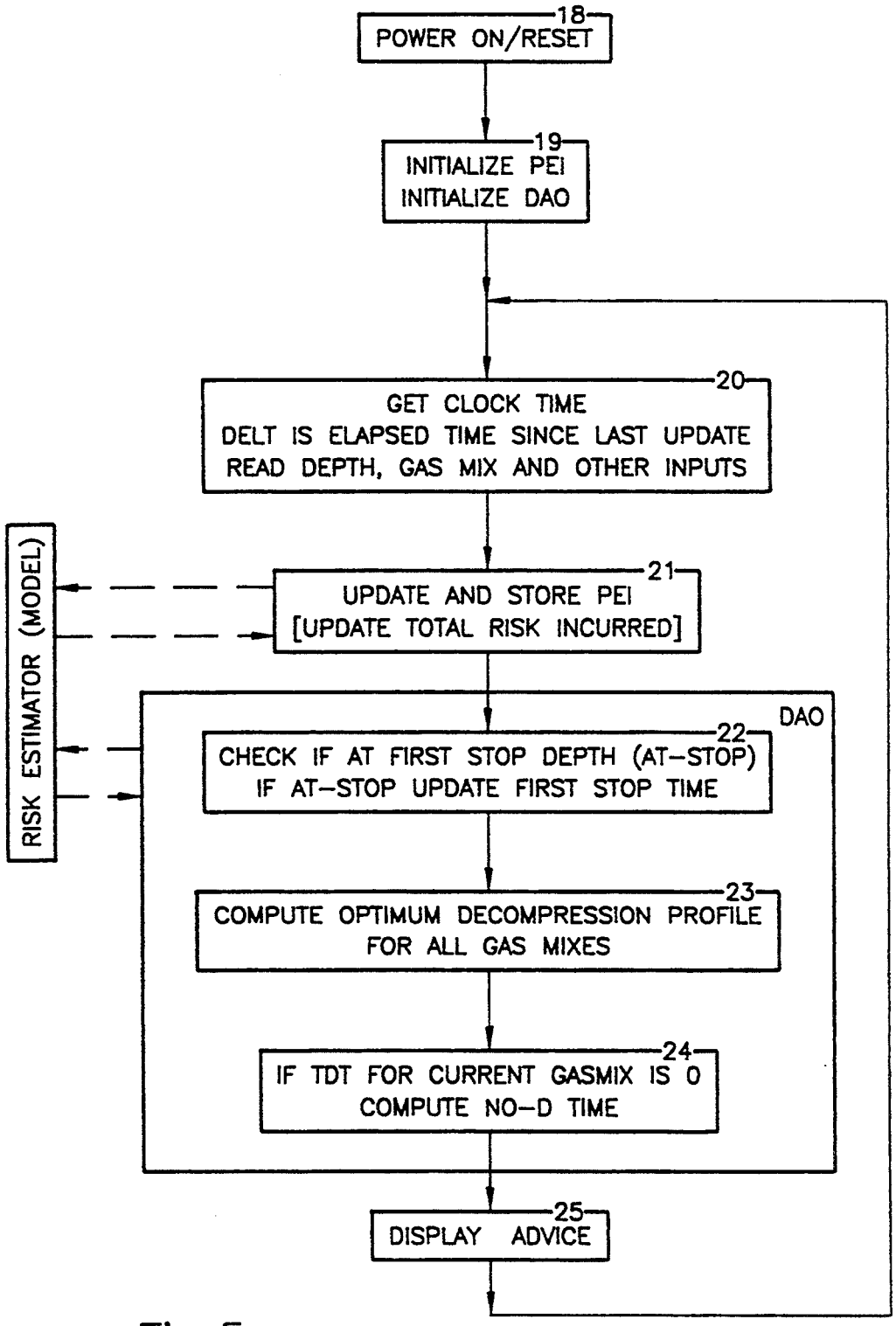
FIG. 5 is a logical flow chart detailing the functional flow of the invention.

Real-time operations are now presented using several figures. FIG. 5 gives more details about the functions involved in FIG. 1. The arrows in solid line indicate the flow of logic, and dotted lines indicate the flow of information. Initially, when the device is turned on, the diver and the device start from a "clean" state of saturation at the current pressure, usually air at about 1 atmosphere pressure, 18. Other initial pressures might be used to reflect some other pressure exposure history. The PIE is initialized to reflect such a state, 19. The DAO is also initialized to reflect TDT of zero minutes and infinite NDT.

At each cycle, values of elapsed time since last cycle, current ambient pressure, and possibly the breathing gas mixture are sensed and stored, block 20. In the physically tested embodiments, the time is provided by the real-time clock oscillator of a MICROVAX-3400 minicomputer and depth by a Mensor digital depth gauge connected to a pressure chamber. Thus, $P_{amb}$ is measured directly. For air breathing, $P_a$ is obtained from equation 8 knowing that $F_R$ was 0.21. For applications where multiple breathing gas mixes are possible, an input switch can indicate which of several pre-planned breathing gas mixes are being used. More generally, an oxygen sensor in the gas supply can physically determine the fraction of partial pressure of oxygen and a simple calculation can be performed.

Next, the PEI values need to be updated, block 21. The old value of the PEI along with a pressure profile from last update time to current time are passed to the Risk Estimator. The Risk Estimator using any embodiment of the risk definition such as equations (3) or (4) and of the presumed gas kinetics such as equations (7) or (10) calculates a new PEI and the risk incurred during the elapsed time interval. The pressure profile can be described as either linear or step change in $P_a$ and $P_{amb}$ since the last cycle. The updated values of PEI are stored for use in the next cycle. The risk incurred since the last update time is also accumulated as the total risk incurred so far by the diver.

Blocks 22, 23, and 24 are all part of the Decompression Advice Optimizer, DAO, shown in FIG. 5. The block 22, establishes whether the current pressure corresponds to the first required decompression stop. Special considerations apply at that stage which will be described later.

Next, the optimum decompression profile is computed (block 23 ) by the DAO, which may be fairly complex. The use of integrals in equation (2) means that there is no unique way to decompress with a specified chance of suffering DCS. Conversely, for any specified level of acceptable risk, $R_{acc}$, there are many ways for a diver to return to the surface. Generally, some constraints are imposed for operational needs or even convenience such as stop depth increments (SDI) and stop time increment (STI) and rate of travel between stops. For example, SDI set to 10 means the diver will take the decompression stops at multiple of 10 feet of sea-water (fsw), or STI set to 5 means the time at the decompression stop is explored in multiples of 5 minutes (in the tested embodiment of the invention SDI of 10 fsw, STI of 5 min, and travel rate of 60 fsw/min were most frequently used). Such constraints reduce the number of possible decompression paths, but, in general, do not produce a unique possibility. As mentioned in Weathersby et al. (1985b [8]),the possible ways to spend 200 minutes of TDT split into 10-minute increments apportioned over 5 decompression stop depths leads to 10,626 different decompression paths. The additional specification for defining an "optimal" decompression schedule is to minimize total time spent decompressing before returning to the surface. The DAO significantly reduces the number of possibilities to be explored. The next section explains in detail how the optimum decompression possibilities are explored.

If the TDT for the optimum decompression schedule is zero minutes, i.e. user can decompress without using any intermediate stops, then the diver is said to be in the no-D state. It could be desirable for the diver to know how long the no-D state would continue if the diver remained at the current depth. This is accomplished by the DAO in block 24 in FIG. 5. Finally, the relevant information is displayed in block 26 and the whole cycle is repeated.

Optimum Decompression Path

In block 23, the DAO computes the decompression schedule with the shortest TDT which does not cause the risk to exceed $R_{acc}$. The DAO finds the optimum decompression schedule by evaluating only the possible decompression profiles nearby to the prior optimum schedule. As will be shown, nearby means close to the same TDT and with required decompression stop depths close to those previously found optimal.

The risk of DCS from a decompression schedule can be defined two different ways. The first method involves using both: the risk incurred so far by the diver up till the current time (block 21) and the projected risk using the decompression schedule from the current time into the future. This method uses "the total risk of DCS" the diver will have incurred if the diver were to follow a specified decompression schedule. The second method uses only the projected risk into the future using the specified decompression schedule and the risk incurred so far is ignored. The second method uses "conditional probability" which will be explained later in the section "Repetitive Diving". The preferred embodiment uses the "conditional probability" definition for evaluating a decompression schedule as follows. Referring back to FIG. 2, let us assume that the diver currently is at Time1, thus the last updated PEI reflects the diver's pressure exposure history up till the current time, Time1 and the decompression profile to be evaluated consists of one intermediate stop as shown from Time1 to Time2 in FIG. 2. Since the diver is projected to remain at the final destination depth (usually surface) for a long time interval (24 to 48 hours), a time interval Time2–Time3 is added to the decompression profile. Thus, the Risk Estimator is given the current PEI at Time 1, and a decompression profile from Time1 to Time3. The Risk Estimator calculates the projected risk between Time1 and Time3 using equation (2) where $T_N$=Time1 and $T_M$=Time3.

Figure 6:
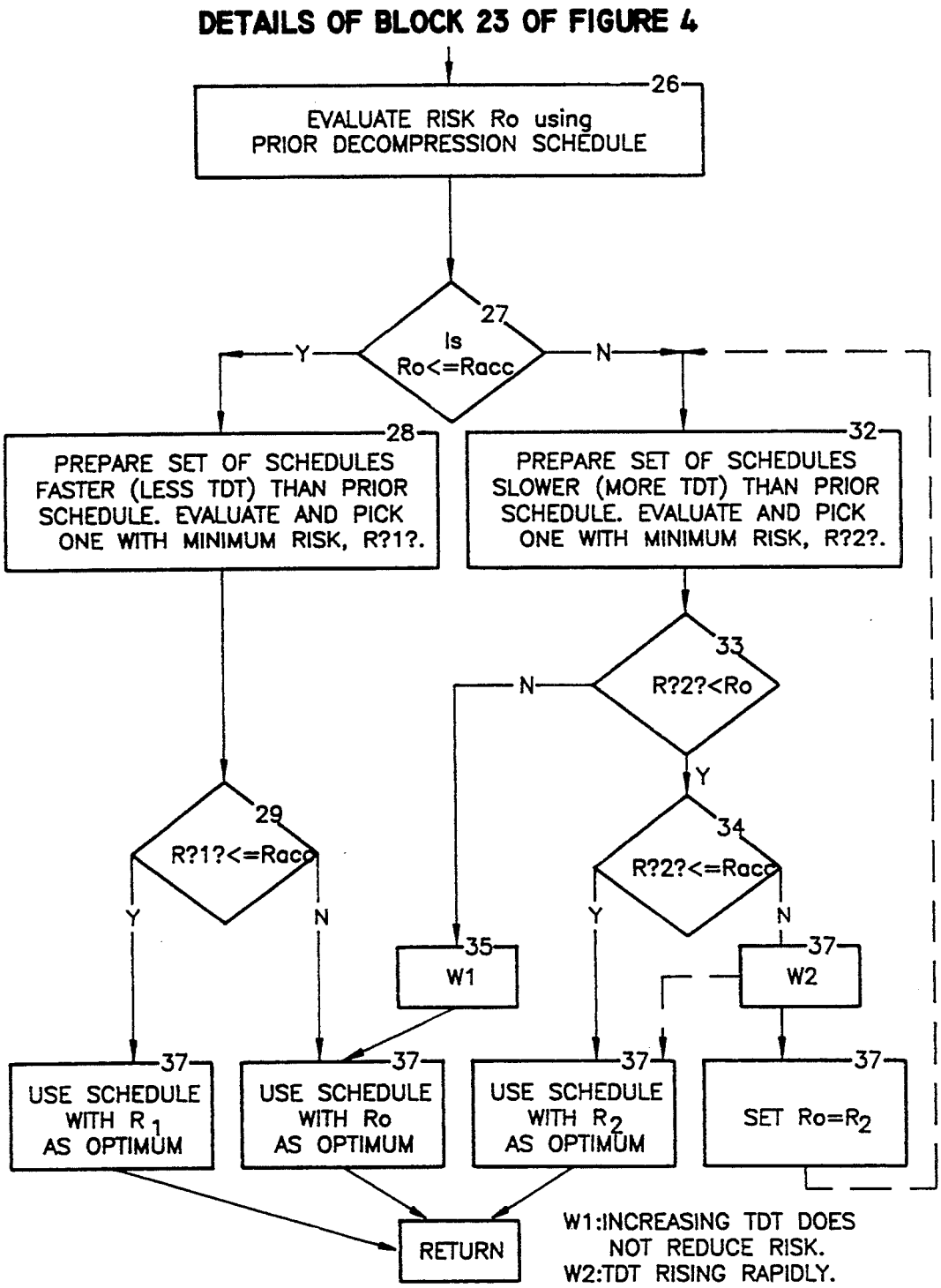
FIG. 6 is a simplified flow chart of the process used to determine the optimum decompression profile in block 23 of FIG. 5.

In block 26 of FIG. 6 the prior optimum schedule is recovered from memory and evaluated using the Risk Estimator as described above. If the evaluated risk of the prior optimum schedule, $R_0$, is lower than the acceptable value, $R_{acc}$, in block 27, then it is possible that the new $P_{tis}$ values have decreased enough to allow a faster decompression. To test this possibility a small set of slightly faster decompression schedules are proposed for evaluation, block 28. This is done by reducing prior TDT by one STI in all possible combinations. For example, if prior TDT was 30 min with stop time at 30, 20, and 10 fsw, and the STI is 5 min, then the 3 schedules with a TDT of 25 min are examined, each proposed schedule having 1 of the 3 stops shortened by 5 min.

Once each proposed schedule is constructed as a set of ramps or steps, it is passed to the Risk Estimator along with the current PEI. The Risk Estimator returns the value of the projected risk involved. It also returns a new PEI value which is not used in this process.

When the collection of shorter proposed schedules has been evaluated for their projected risks of DCS, the schedule with the lowest risk, $R_1$, is chosen to compare against the preset acceptable risk, $R_{acc}$, block 29. If $R_1$ is low enough to be acceptable, then the corresponding schedule is taken as the new optimum, block 30. Schedules shorter than one 5-min STI are not evaluated because the prospect of TDT decreasing more than one STI (5 min) in a single 5-second to 10-second update is too remote to consider. If $R_1$ is more than the acceptable risk value, the prior optimal schedule is retained, block 31. This means that the $P_{tis}$ values have not decreased enough to allow shortening the schedule, however the values of $P_{tis}$ have not increased enough either to cause lengthening of the decompression schedule.

When the risk $R_0$ using the previous optimum schedule exceeds $R_{acc}$ in block 27, longer schedules need to be examined. This is done by adding one STI to the prior TDT in all possible combinations including one deeper stop, block 32. Using earlier example of stop time at 30, 20, and 10 fsw would lead to exploration of four proposed schedules by adding one STI at 40, 30, 20, and 10 fsw. A schedule producing the lowest risk, $R_2$, is chosen for comparison.

Next the possibility needs to be examined whether increasing TDT produces the expected effect of reduction in the projected risk, block 33. In most cases this will be true. However if the acceptable risk level, $R_{acc}$, is set too low, it may be mutually inconsistent with the chosen constraint of SDI (stop depth increment) and travel rate. For example, a large but possible SDI of 25 fsw will involve some inherent risk, which is unavoidable. Block 33 checks for unusual conditions like this. If $R_2 < R_o$, a warning signal can be set in block 35, and the prior optimum schedule is retained in block 31. If increasing TDT does in fact reduce the projected risk as expected, it is further checked if the reduced projected risk, $R_2$, is lower than the acceptable risk level, $R_{acc}$, block 34.

In most cases the procedure of checking a single increment longer proposed schedules will produce at least one schedule with risk below the acceptable value. In extreme cases it will not. If, for example, the increase in the $P_{tis}$ values is such that the current TDT needs to be more than one STI longer than the prior TDT, then several strategies could be adopted. In the first case, shown at flow path 37-38 and back to 32 in FIG. 6, the best (safest) proposed schedule corresponding to $R_2$ with +1 STI could be saved as the prior schedule in block 38 and then another search could be performed in block 32, therefore producing a set of +2 STI schedules. If that is still insufficient to meet the requirements of $R_{acc}$, then a third round, etc., could be tried.

If a version of the invention is used which does not have much surplus processing time per cycle, it can implement an alternative pathway, 37-36 in FIG. 6. In such a version, additional longer schedules are not explored. Eventually, at some subsequent update cycle, the specified decompression will "catch up" and match $R_{acc}$.

Block 37 can represent at least two types of warnings. In the first case of exploring multiple additional time increments, it signals that the TDT is rising very rapidly. In the second case, it signals that the optimum decompression profile is riskier than the acceptable risk level.

In the embodiment of the invention tested in 1991 and 1992 a Digital Equipment Corporation MICROVAX 3400 minicomputer was used. With this computer processing speed was not a major problem, with update cycles of 5 seconds being easily achieved with enough speed so that the +2 and +3 time increments implied in blocks 37-38-32 of FIG. 6 were actually implemented.

As a further specific example using the nearby search, consider that the prior optimum schedule (using 10-foot stop-depth increments and 5-minute stop-time increments) was as follows:

| 40 ft | 30 ft | 20 ft | 10 ft | TDT |
|---|---|---|---|---|
| — | 5 min | 5 min | 20 min | 30 min |

Then the examination of one faster increment in block 28 would evaluate the following three proposed schedules:

| | | | | |
|---|---|---|---|---|
| — | — | 5 min | 20 min | 25 min |
| — | 5 min | — | 20 min | 25 min |
| — | 5 min | 5 min | 15 min | 25 min |

If the logic of block 32 were needed, the following longer proposed decompression schedules would need construction and evaluation:

| | | | | |
|---|---|---|---|---|
| — | 5 min | 5 min | 25 min | 35 min |
| — | 5 min | 10 min | 20 min | 35 min |
| — | 10 min | 5 min | 20 min | 35 min |
| 5 min | 5 min | 5 min | 20 min | 35 min |

If these possibilities were all inadequate and path 38-32 were followed, another four or five possibilities would be tried, all with a TDT of 40 min.

It can be seen that the number of candidate schedules to examine is quite small compared to the full number of possibilities. In the case of examining up to a single time increment more, the total schedules examined is equal to N+2 per update cycle where N is the number of decompression stop depths of the prior schedule which will typically not exceed N=5 thereby requiring not more than 7 schedules to be examined.

The potential necessity to examine an even greater number of schedules is related directly to the rate at which TDT increases per unit of continued time at depth. That change in TDT is found to depend upon $R_{acc}$, with smaller acceptable risks increasing the TDT rate; upon the diver's depth, with deeper depths increasing the TDT rate; and upon how long the diver has been at depth, with the TDT rate first rising with increasing dive time and later diminishing. Eventually the TDT rate will go to zero as all of the compartments become fully "saturated" in equilibrium with the inspired gas at that depth. The TDT rate increases can be severe under some conditions. Using the preferred embodiment parameters and simulating a diver breathing air at a depth of 180 fsw and setting a $R_{acc}$ of 2.0%, the rate of increase in TDT exceeds 140 min per additional minute at 180 fsw after about 24 min at that depth. If the STI is 5 min, and an embodiment limits the TDT increases to +1 increment (path 37-36), then the processor must be fast enough to respond with the update interval of less than 2.15 sec (5×60/140), so as not to give warning signals. If the update cycle time is 10 sec and the STI is 5 min, then using an embodiment that limits at +1 increment, the maximum rate of increase in TDT that can be accommodated is 30 (5×60/10) minutes per minute additional at depth.

From the discussion of TDT rate, it is clear that different applications may require different specific embodiments of the device. For example, to operate at deep depths and low acceptable risk levels, a rapid update rate (2 sec) is desirable to allow following high rate of TDT increase. If the device is to be used for relatively short, shallow dives usually accomplished by sport divers (depth<130 feet, close no-decompression limits) then a cycle time of 10 sec is more than adequate. In each specific hardware embodiment the minimum cycle time must be determined as well as the potential impact of this cycle time on computing dive profiles. If optimized dive profiles in certain ranges of depth and time cannot be computed within the cycle time, then warnings would have to be implemented as discussed above. Clearly, choosing a processor that has faster cycle times decreases the chance of encountering a condition for which the optimal decompression profile cannot be computed.

No-Decompression Time (NDT)

If the risk of immediate ascent to the surface is acceptable (no-decompression situation), how much longer will it remain so? That answer is the remaining no-decompression time (NDT) and is usually desired by the diver on the display. The answer is obtained by constructing profiles that remain longer at the current depth, followed by direct decompression to the surface and evaluating their risk using the Risk Estimator. This is a classic root-finding problem in mathematics and many strategies are available to perform an efficient search for remaining no-D time (NDT). In 1991-92 full-scale tests, a variable step-size bisection method worked well. The process ceases when either the remaining safe time is known to acceptable precision (the maximum precision of one update cycle) or until projected risk is quite close to the acceptable level. In our testing, the precisions for NDT from as coarse as one minute to as fine as one update cycle (5 and 10 sec) were used with satisfactory results. The actual number of profiles to be evaluated by this methodology seldom exceeds a few dozen. Economy is obtained because linear interpolation on a logarithm of risk versus time scale is usually fairly precise and especially because an excellent initial starting value is available from the stored value of No-D time, which was obtained at the end of the previous cycle.

Provision is also made for minor points, such as quitting the No-D search if a very long time, say 9999 min, is safe as would be the case if the diver had yet to proceed deeper than 10 fsw.

Display

The current total decompression time (TDT) will normally be an item of high interest and sent to the diver's display. The depth of the first (deepest) stop will also be of interest. The exact distribution of stop times across stop depths may be of lesser interest, but could be used in auxiliary algorithms that could, as in U.S. Pat. 4,882,678, calculate SCUBA gas supply and gas usage rates (which are depth dependent) and thereby the estimated usable time of the bottled gas supply.

Special Functions During Decompression (block 22, FIG. 5)

When the diver is actually following the prescribed decompression schedule, other approaches might be desirable. A simple embodiment would be to cease examining new decompression possibilities and simply decrement the value that displays the remaining time required at the current stop depth. This simple embodiment will have a problem if the diver strays from the prescribed decompression path. A more refined approach would be to continue examining the adequacy of decompression by updating decompression possibilities following the flow of FIG. 6. The optimal decompression path can, in fact, change due to slight variations in the diver's actual depth as compared to the prescribed decompression path being followed and due to implementing conditional probability (discussed below). This however will have the undesirable effect of sudden changes in the stop time as the diver spends time at the prescribed stop depth. A useful constraint is to "freeze" the time at the decompression stop depth once the diver arrives at that depth, to avoid surprising the diver. This is achieved (in blocks 28 and 32 of FIG. 6) by not examining schedules that make change to the time at current stop depth. Time at the current stop depth will then decrement as the diver spends time at that depth. The adjustments can be made to the shallower stop times. This is not possible at the shallowest depth, for example 10 fsw, and a conscious trade-off needs to be performed between the undesirability of surprising the diver and the undesirability of surfacing with a risk significantly different (lower) from $R_{acc}$.

Figure 7:
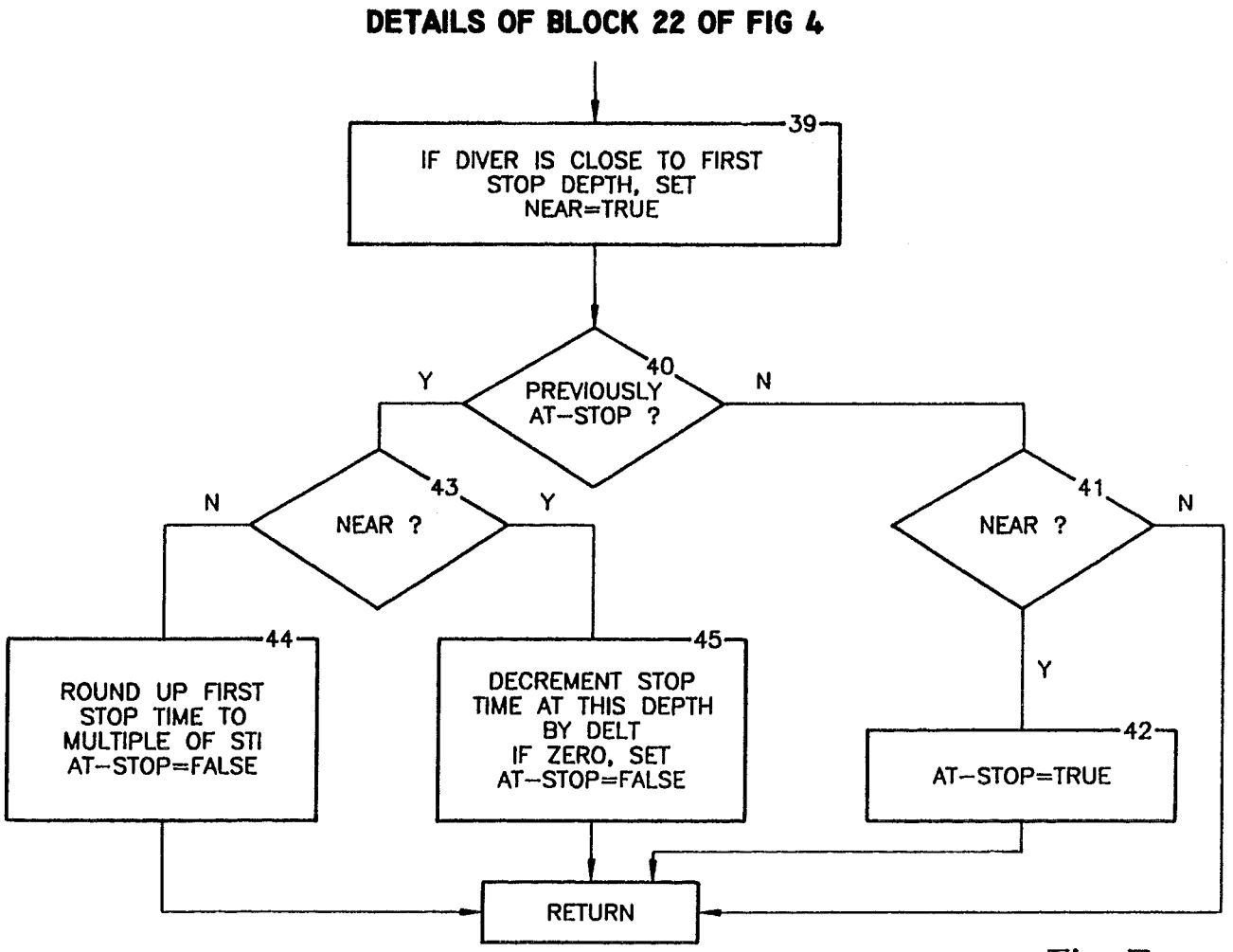
FIG. 7 is a flow chart giving details of AT-STOP logic as used in block 22 of FIG. 5.

The embodiment tested in 1991–92 had a more elaborate approach. A tolerance of 2 fsw about the deepest decompression stop depth according optimal schedule was used to establish a "NEAR" condition. FIG. 7 shows some details of the embodiment. The very first time the diver arrives at the prescribed decompression stop depth, "NEAR" condition is set in block 39. Since the diver was not "AT_STOP" previously, block 40, path 41 and 42 is followed, and AT_STOP condition is set. Subsequently as the diver spends time at that stop depth, paths 43 and 45 are used, and the stop time is decremented, eventually leading to zero stop time, which leads to clearing of "AT_STOP" condition. If the diver for any reason strays from the stop depth, the condition "NEAR" is cleared, the time at the last stop depth is then rounded up to the nearest multiple of STI, the stop time increment, and AT_STOP condition is cleared (path 40, 43, 44). This then allows the schedule-optimization logic (FIG. 6) to freely change the time at that depth.

The AT_STOP logic in the tested embodiment in fact, was somewhat more complex because it also allowed for the instantaneous switch to other gas-mixes as described later.

Repetitive Diving

Once the diver has completed decompression and surfaced, it is not necessarily advisable to simply shut down the device. Without safeguards, the next use may be dangerously unacceptable. Restarting the real-time invention would implement the assumption that the diver's body tissues are equilibrated with atmospheric air, that $P_{tis}$ values are all near Pa. Such a condition is not achieved for a significant time, from a few hours to over a day following a multi-hour dive. If another dive is anticipated, it is preferable to leave the device operating and updating PEI calculations. An alternative solution is to manually input the PEI.

Performing a second dive presents another problem: what should be the acceptable chance of DCS, $R_{acc}$. If the first dive required decompression stops, the total incurred risk upon completion of the dive should have been very close to $R_{acc}$. If the diver were to return to pressure, there might very well be no way to decompress the second time without a total incurred risk well in excess of $R_{acc}$. There are a variety of ad-hoc means of avoiding that quandary, such as by manually setting $R_{acc}$ higher or decrementing the total risk accumulated in the device (block 21). However, there is a more natural solution. Since the invention has been calibrated with information on the time when DCS symptoms appear, it is now rational to act on that embodied information. A formal mechanism to accept the minute by minute validity of well-calibrated risk functions is afforded by the term "conditional probability"; well known in the statistical arts and applied in Weathersby et al, 1992a [10].

In a vernacular sense, conditional probability refers to an individual willing to incur a new risk similar to one which was incurred previously. In a more technical sense, it accepts that the chance of being safe up until the present time is acceptable, therefore, the risk assumable into the future is the same as the last opportunity to assume the risk. In mathematical terms, it corresponds, in equation (11), to setting the first term of safe until $T_1$ as certain, thus 1.0. The second term in equation (11) is then the future risk of DCS, on the conditional assumption that events until now (the meaning of $T_1$ in this sense) is acceptable. In a practical sense, it differentiates between assessing the lifetime risk of DCS and the risk on the next dive planned.

It is obvious that if the first term in the equation (11) is set to 1, the equation (11) is equivalent to equation (2). The preferred embodiment of the invention implements conditional probability. This is done by using equation (2) with $T_N$ as the current time and $T_M$ set to some time (usually 24 hrs) after the projected schedule.

Concern could arise on using conditional probability on single dives with substantial TDT since risk incurred at earlier, deeper decompression stops would be "forgotten", and shallower stop times could then be allowed to shorten. Qualitatively that process does occur. However, using the preferred embodiment parameters, the quantitative implications are not very severe. For most decompressions, the difference between conditional and non-conditional schedules is less than 3 or 4 stop time increments and overall total dive cumulative risk increases by no more than about 0.2% DCS. In severe dives with many hours of decompression stop time, the difference is more noticeable with occasional differences of 10–15% in TDT and overall cumulative risk rises of up to 20% of $R_{acc}$. The effects are not larger with the preferred embodiment because most of the risk occurs on the surface and at the shallowest stop depth, which is not allowed to change because of the previously described "AT_STOP" logic.

Variable Risk

To this point, $R_{acc}$ has been treated as a single number regardless of the type of dive. Different pre-set values could be used, for example, depending on the importance of the purpose of the dive, or upon the availability of additional resources such as a nearby recompression treatment chamber. But it can also be desirable to have $R_{acc}$ change during the dive itself between specified maximum and minimum values. When decompression is not a great concern, such as early in the No-D range, a lower conservative $R_{acc}$ could be used. Such a choice is reasonable since many recreational dives in the No-D range are performed by modestly trained people and in areas where DCS treatment facilities are not close at hand. At the other extreme are long arduous dives with hours of decompression stops, generally performed by professionals, either commercial or military, and with well practiced support systems in place. For long dives, the risk of DCS has to be balanced against the risks of cold, dehydration, hunger, etc. of requiring the diver to stay in the water for a long TDT based on a low $R_{acc}$. The time can be quite lengthy. For example, using the preferred embodiment parameters, after an air dive to 150 fsw for 60 min, the TDT is 27 hours for a $R_{acc}$ of 2% but decreases to under 7 hours if $R_{acc}$ is relaxed to 7%.

Figure 8:
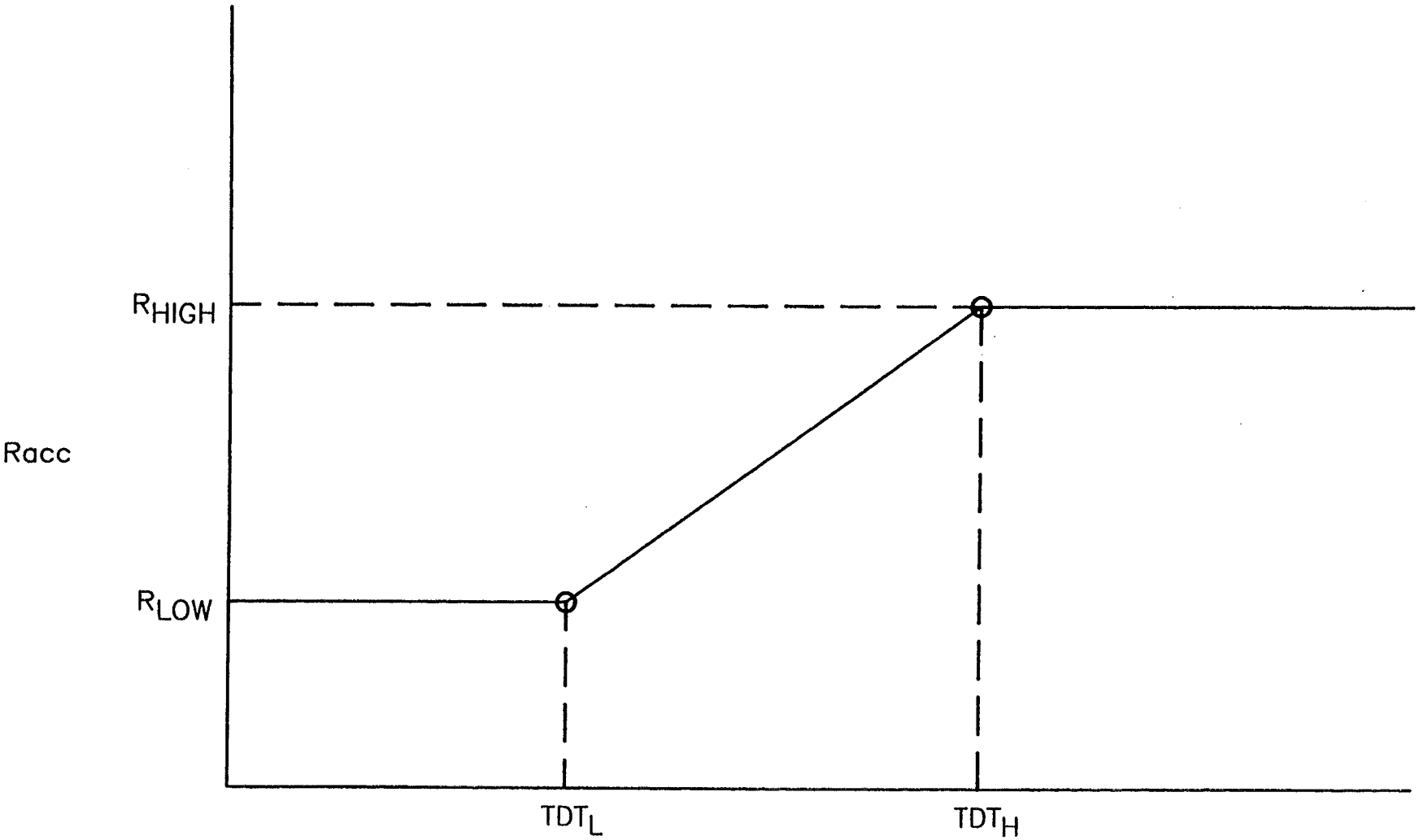
FIG. 8 is a graph showing how $R_{acc}$ varies as function of TDT.
Figure 9:
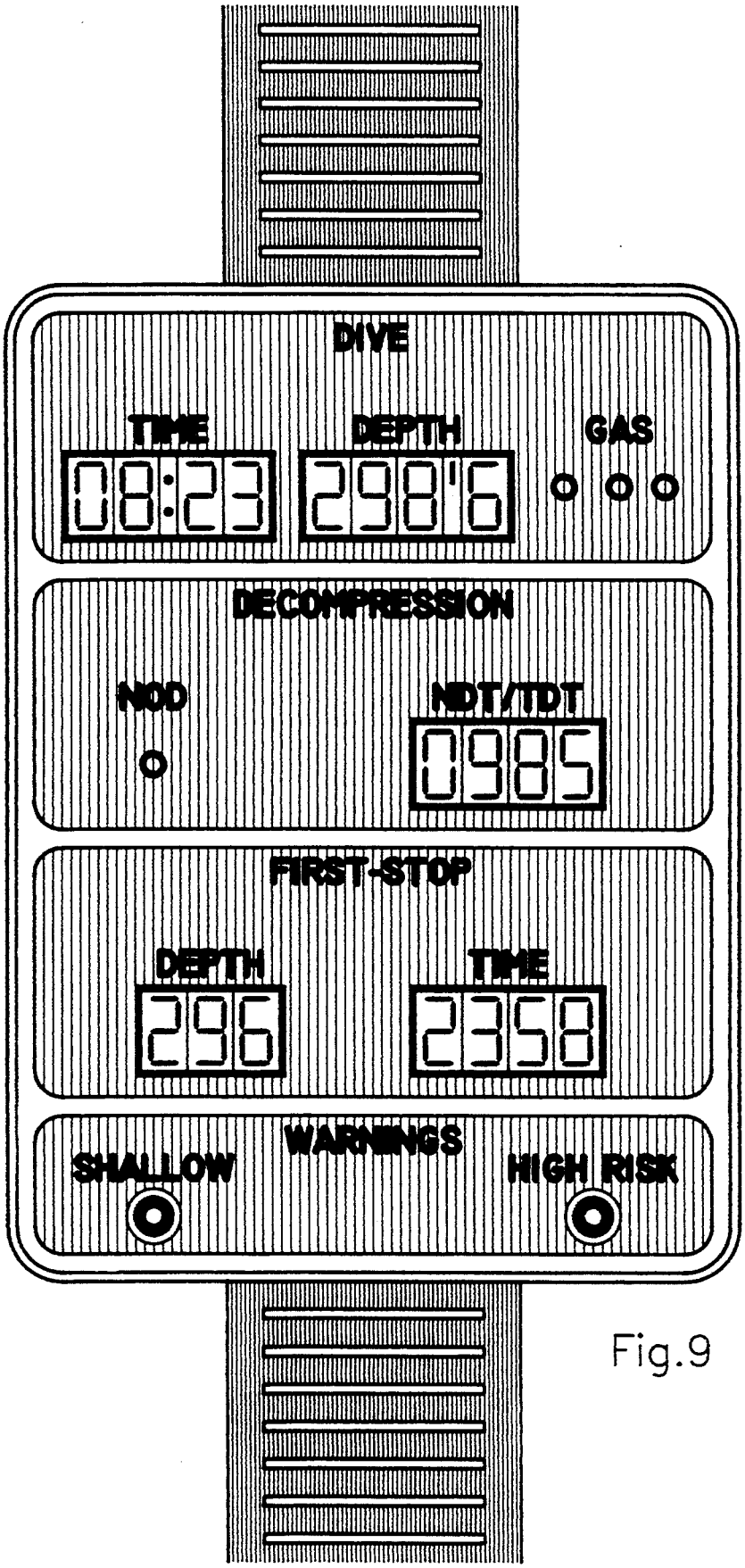
FIG. 9 is a simplified sketch of a device in accordance with the present invention used as a wrist-carried device.

Variable $R_{acc}$ can be implemented in the real-time invention by several methods. The first method changes acceptable risk based on TDT such as shown in FIG. 8. For No-D dives and dives with very little TDT up to $TDT_L$, the low conservative value of $R_{LOW}$ is used as $R_{acc}$. More severe dives allow $R_{acc}$ to rise. The rise can be unbounded or, as illustrated in FIG. 8, can stop at a some maximum risk of $R_{HIGH}$ when TDT reaches a value of $TDT_H$. This functionality should be gradual to avoid undesirable outcomes. For an example, if $R_{acc}$ increases rapidly with TDT, (i.e. slope of the line in FIG. 8 is steep), the illogical possibility exists of the TDT actually decreasing on subsequent update cycle as a result of rapid increase in $R_{acc}$. Special care is needed to prevent an annoying flicker in TDT values. In the tested embodiment, this was accomplished by using two possibly different values of $R_{acc}$ in block 29 and 34 in FIG. 6. A value $R_{acc1}$ is continuously tracked such that it is the maximum of either $R_{LOW}$ or the highest projected risk from all prior cycles ( $R_1$ from block 30 or $R_0$ from block 31 or $R_2$ from block 36). $R_{acc1}$ is used in the block 29 where it is checked if TDT can be decreased. A value $R_{acc2}$ is derived from the maximum of either $R_{acc1}$ or a value obtained from FIG. 8 using the variable functionality. $R_{acc2}$ is used in block 34 to see if TDT should increase. Suppose a diver completes a dive with a decompression time greater than $TDT_H$. As the diver arrives at the surface, $R_{acc2}$ will be equal to $R_{HIGH}$ and $R_{acc1}$ will be slightly less than $R_{acc2}$. At this time, (in fact at any time when the projected TDT is zero), $R_{acc1}$ is made equal to the maximum of either the diver's future risk $R_0$ in block 31) or $R_{LOW}$. Thus the value of $R_{acc}$ is gradually reduced to $R_{LOW}$ as the divers future risk falls.

Other methods of varying the acceptable risk, $R_{acc}$, are also possible. One such method could be provided by a function similar to that in FIG. 8, but based not on TDT but on another measure of dive severity such as the calculated risk if the diver were to surface immediately regardless of the TDT. It is also possible to let the user vary the risk as the dive progresses to allow decompression profiles to be computed that are at risk levels commensurate with other risks (hypothermia, injury). However, this implementation would require a high degree of sophistication and training of the diver and would likely be implemented only in exceptional circumstances.

Different Breathing Gas Mixes

The invention can also be embodied to allow the diver to profitably employ two or more different gas mix supplies to breathe. For example, compressed air could be the primary gas and a second supply, relatively enriched in oxygen, could be available. The second source might be unsuitable for the entire dive because of limited supplies or from a concern for oxygen toxicity if used at deeper depths. In general, the diver might switch to the alternate gas supplies at any time. To be prepared for a sudden switch, a separate optimized schedule is prepared according to FIG. 6 for each gas mix. The PEI is updated according to the gas which has been in use, but future projections of possible decompression schedules are based on parallel processes that assume each available breathing gas will be used on the next cycle. Additional constraints and operating procedure assumptions can easily be embodied, for example, a prohibition on using a particular supply deeper than a specified depth, or a switch to normal air expected as soon as a diver surfaces. Another embodiment could track a "worst case" that assumes the diver has been breathing the lowest oxygen content gas throughout the dive. The different decompression paths and TDTs could be displayed to the diver to aid in planning, and free standing simulations of the invention can be used profitably in overall mission planning. The actual switch of supplies can be signalled by a manual switch, be sensed by a link to the gas supply system, or could be decided by a physical gas composition detector, for example, an oxygen electrode, and a calculation made to compare the gas analysis to a stored list of supply gases. Since, in general, different gas supplies would lead to different TDTs, a different means is possible for each gas to follow a real-time variation in $R_{acc}$. Choices could be resolved depending on the purpose of switch, that is, increased safety versus lower TDT. For example, $R_{acc}$ for each gas mix could be a separate independent function. Alternatively, the possible gases could follow the same $R_{acc}$ function, for example $R_{acc}$ as a function of TDT of air or $R_{acc}$ as a function of a gas-independent variable such as the estimated risk if the diver were to surface immediately.

If multiple gas mixes are implemented, additional complexities have to be added to the "AT_STOP" logic in FIG. 7. For example, let us assume that the invention is implemented for 2 gas mixes, the diver is currently breathing gas mix 1 and is at its prescribed stop depth of 20 fsw with remaining stop time of 2 min. Let us also assume that the first stop depth for the 2nd gas mix is 30 fsw with prescribed stop time of 10 min. Now, if the diver switches to gas mix 2 and moves to 30 fsw on the next update cycle; the "AT_STOP" logic should be able to recognize the fact that the diver has moved from "AT_STOP" of gas 1 to "AT_STOP" of gas 2, and be able to round up the stop time of gas 1 and "freeze" the stop time of gas 2 and decrement it in the future. Thus, just by checking previous "AT_STOP" (block 40 in FIG. 7) condition does not directly lead to decrementing the stop time, but additional steps have to be taken to check if previous gas mix is same as the current one and extra logical pathways have to be added. The additional logic is straightforward once the complexities are well understood.

Since the invention embodies a reliable and calibrated means of estimating short term chances of suffering DCS, other advantages are present. For example, by accident or by operational necessity, the diver may not always follow the optimum decompression path. The real-time embodiments do not require that the diver behave optimally and will continue to provide a path of controlled risk even if the diver has briefly assumed greater risk than planned, for example, gone to the surface for a brief time. The optimal TDT will naturally be updated and appear as advice to the diver to return to a deeper depth. However, the conditional probability implementation will continue to provide a decompression schedule based on future risk. In this scenario, it may be prudent to modify, say $R_{acc}$ downward, to compensate for an unplanned spike in the instantaneous risk incurred by the diver. Other warnings and emergency recovery implementations are clearly possible using the information naturally present within the invention.

Full Scale Testing

The invention has been successfully tested in several embodiments. Major tests used the clock and processor of a MICROVAX-3800 computer (Digital Electronics Corp.) and a Mensor digital Pressure gauge, Model 11900 (Mensor, Inc.) gauge connected to large Navy man-rated pressure chambers in Bethesda, Md., and MICROVAX-3400 computer in Panama City, Fla. Output information of the invention consisting of current dive time, present depth, remaining No-D time (if in that status), TDT (if non zero), depth of first decompression stop, and gas mixture in use were displayed to the Diving Supervisor who then directed necessary actions of divers and technicians. The preferred Risk Estimator as described was loaded with one of two sets of parameters including the preferred set. Gases were air only; or air and 36% or 48% oxygen in nitrogen. Decompression stops were set in 10 fsw and 5 min increments. Test depths varied between 80 and 150 fsw, dive times from 30 min to 8 hours, and 1, 2, or 3 repetitive and/or multilevel profiles were followed. Levels of $R_{acc}$ were set at 5%, 7%, or on a sliding scale of 2.5% ($R_{LOW}$) at $TDT_L$ of 20 min increasing to a maximum of 5% ($R_{HIGH}$) at $TDT_H$ of 60 min. Decompression stop times were "frozen" if within 2 fsw of the indicated next stop depth. Full conditional probability was implemented. An accelerated simulation driven by an automatic data log file was also implemented to allow recovery after power failure or other procedural problem. In over 700 man-dive tests, no major or unrecoverable error occurred, no TDT or individual stop time was more than 2 time increments different from expected values, and no other failure occurred which would compromise the claims of the invention.

Many other tests were performed with simulations in which depth, time, and gas content were provided as input in computer files and the invention was run faster than realtime. The success of the limited search strategy of FIG. 6 was verified by comparison to the much more comprehensive search described in Weathersby et al (1985b) over the depthtime grid tabulated in the 1956 U.S. Navy Air Decompression Tables. Agreement was perfect in about 85% of the cases; about 10% differed in placement of 5 or 10 min between 2 different stop depths, and in the remaining cases, TDT disagreed by 5 or 10 min. Numerous other tests and checks were performed to verify the absence of failure modes.

A fully portable embodiment of the invention configured for use by a single diver will be able to use a version of the algorithm which has been written in a computer language suitable for programming a microprocessor chip. Execution time for calculating projected risk using 55 different decompression profiles, an extreme number even for multiple gas use, was evaluated on several different computers. Only 0.5 seconds were needed on a VAX 4000, but a PC 486/33 took only 0.8 seconds and a PC 386/25 required 2.5 sec. The cycle time for each specific hardware implementation would, however, need to be determined and the impact on decompression profile calculation determined and appropriate warnings implemented, if required, as discussed above.

Other Applications

The main method of conveying the optimal decompression advice is by visual display. However, this information could be conveyed as printed decompression profiles if the device is used with simulated inputs for dive planning, dive analysis, or to compute sets of decompression tables for pre-determined depth and time increments and specified breathing gas compositions. Also, the information can be conveyed as signals to controller mechanisms that could actually manipulate chamber or divers ambient pressure based on the optimal decompression advice.

REFERENCES CITED IN THE APPLICATION (1) Boycott, A. E., Damant, G. C. C., Haldane, J. S. "The prevention of compressed air illness." Journal of Hygiene (Camb), 8:342, 1908.

(2) Workman, R. D. "Calculation of decompression schedules for N2-O2 and He-O2 dives." Washington, D.C.: NEDU Report 6-65, May 1965.

(3) Gray, J. S., Wigodsky, H. S., Masland, R. L., and Green, E. L. "Studies of altitude decompression sickness. IV. Attempts to avoid decompression sickness by selection of resistant personnel." *Journal of Aviation Medicine,* 34:88–95, 1947.

(4) Weathersby, P. K., Homer, L. D., and Flynn, E. T. "On the likelihood of decompression sickness." *Journal of Applied Physiology,* 57:815–825, 1984.

(5) Kalbfleish, J. D. and Prentice, R. L. *The statistical analysis of failure time data.* New York: Wiley, 1980.

(6) Elandt-Johnson, R. C. and Johnson, N. L. *Survival models and data analysis.* New York: Wiley, 1980.

(7) Weathersby, P. K., Survanshi, S. S., Homer, L. D., Hart, B. L., Nishi, R. Y., Flynn, E. T., and Bradley, M. E. "Statistically based decompression tables. I. Analysis of standard air dives: 1950–1970." Technical report of the Naval Medical Research Institute, Bethesda, Md.: NMRI 85-16, 62 pp., March 1985. (1985a)

(8) Weathersby, P. K., Hays, J. R., Survanshi, S. S., Homer, L. D., Hart, B. L., Flynn, E. T., and Bradley, M. E. "Statistically based decompression tables. II. Equal risk air diving decompression schedules." Technical report of the Naval Medical Research Institute, Bethesda, Md.: NMRI 85-17, 60 pp., March 1985. (1985b)

(9) Marquardt, D. W. "An algorithm for least-squares estimation of nonlinear parameters." *J. Soc. Ind. Appl. Math.* 11: 431–441, 1963.

(10) Weathersby, P. K., Survanshi, S. S., Homer, L. D., Parker, E. C., Thalmann, E. D. "Predicting the time of occurrence of decompression sickness." *Journal of Applied Physiology*, 72:1541–1548, 1992. (1992a)

(11) Vann, R. D. "Likelihood analysis of decompression data using Haldane and bubble growth models." Proceedings of the 9th Symposium on Underwater Physiology, p. 165–181, 1987.

(12) Parsons, Y. C., Weathersby, P. K., and Survanshi, S. S. "Statistically based decompression tables. V. Application of the Haldane-Vann models to air diving." Technical report of the Naval Medical Research Institute, Bethesda, Md.: NMRI 89-34, 62 pp, May 1989.

(13) Thalmann, E. D. "Phase II testing of decompression algorithms for use in the U.S. Navy underwater decompression computer." Panama City, Fla.: NEDU Report 1-84, January 1984.

(14) Nishi, R. Y., and Lauckner, G. R. "Development of the DCIEM 1983 decompression model for compressed air diving." Downsview, Ontario: Defence and Civil Institute of Environmental Medicine, DCIEM Report 84-R-44, September 1984.

(15) Parker, E. C., Survanshi, S. S., Weathersby, P. K., and Thalmann, E. D. "Statistically based decompression tables. VIII. Linear-Exponential Kinetics." Technical report of the Naval Medical Research Institute, Bethesda, Md.: NMRI 92-73, 60 pp, September 1992.

(16) Weathersby, P. K., Survanshi, S. S., Nishi, R. Y., and Thalmann, E. D. "Statistically based decompression tables. VII: Selection and treatment of primary air and $N_2$-$O_2$ data." Joint technical report of Naval Medical Research Institute, Bethesda, Md., and Naval Submarine Medical Research Laboratory, Groton, Conn.: NSMRL #1182 and NMRI 92-85, 64 pp, September 1992. (1992b)

(17) Weathersby, P. K., Hart, B. L., Flynn, E. T., and Walker, W. F. "Role of oxygen in the production of human decompression sickness." *Journal of Applied Physiology*, 63:2380–2387, 1987.

(18) Ku, H. H. "Notes on the propagation of error formulas." *Journal of Research of the National Bureau of Standards*, 70C:263–273, 1966.

(19) Kelleher, P. C., Thalmann, E. D., Survanshi, S. S., Weathersby, P. K. "Verification trial of a probabilistic decompression model." *Undersea Biomedical Research*, June 1992.

Obviously, many modifications and variations of the present invention are possible in light of the above teachings. It is therefore to be understood that, within the scope of the appended claims, the invention may be practiced otherwise than as specifically described.

What we claim is:

1. A device for calculating and signaling decompression advice to a user based on a given pressure time history and upon a specified level of risk of decompression sickness comprising:

a. a means for storing an experience algorithm for the quantitative risk of decompression sickness which has been objectively calibrated to actual background experience information of prior exposures of humans to various pressures for various times correlated with decompression sickness occurrence from such prior exposures, b. means for presetting a value for the specified risk of decompression sickness into the device, c. a clock for providing a time signal, d. a pressure transducer for measuring ambient pressure in the vicinity of the user and providing real-time pressure signals, e. a means responsive to the time signal and the pressure signal for calculating and storing a repetitively updatable Pressure Exposure Index reflecting the user's entire cumulative pressure time history up to the present, f. a processor which uses the stored experience algorithm operating at said preset specified level of risk, and at least the time signals and the pressure signals to update the Pressure Exposure Index, and to perform calculations to provide repetitively updated optimal decompression advice, g. a means of storing the updated optimal decompression advice, and h. a signal means for supplying the optimal decompression advice to the user in real time whereby the user is provided the signal as advice to govern the user's own physical movements into areas of different ambient pressures.

2. A device as in claim 1 wherein the experience algorithm which updates the optimal decompression advice does so by an efficient local search in the vicinity of prior optimal decompression advice.

3. A device as in claim 1 wherein the experience algorithm has been calibrated with previous pressure-time exposure experience comprising the time periods during which decompression sickness symptoms are more likely and less likely to occur.

4. A device as in claim 1 wherein the calibration of the experience algorithm with actual experience is performed using objective statistical measures.

5. A device as in claim 4 wherein the statistical measure is related to maximum likelihood.

6. A device as in claim 1 wherein the pressure exposure index is initialized to values appropriate to the user at the time of initialization.

7. A device as in claim 1 wherein in the pressure exposure index can be preset with values representing a previous pressure time history.

8. A device as in claim 1 wherein the device controls other controller mechanisms to accomplish decompression profile by physical control of ambient pressure.

9. A device according to claim 1, further comprising means for providing data to the device indicating which gas composition is being breathed, wherein the Pressure Exposure Index reflects which gas composition is being breathed, and wherein the device provides optimal decompression advice for all specified gas compositions.

10. A device according to claim 9, wherein the means for providing data to the device indicating which gas composition is being breathed comprises means for sensing the gas composition.

11. A device as in claim 1 wherein means for presetting the specified level of risk may be reset by the user at will.

12. A device as in claim 1, further comprising at least one additional display for warning the user when conditions exceed the ability of the processor to update optimal decompression advice.

13. A device as in claim 1 further comprising at least one additional display for warning the user when the user disregards optimal advice while still providing the best decompression advice possible.

14. A device as in claim 1 wherein the specified level of risk of decompression sickness applies to risk of occurrence of decompression sickness projected at various times in the future.

15. A device as in claim 1 wherein the specified level of risk of decompression sickness is defined by a risk function given by $$P(DCS_{TN-TM}) = 1 - e^{-\int_{TN}^{TM} r dt}$$

where the instantaneous risk r is defined by a sum of individual risks in multiple compartments as given by $$r = \sum_{i=1}^{K} r_i .$$

16. A device as in claim 1 wherein the specified level of risk of decompression sickness is defined by a risk function where the risk is defined by a sum of compartmental risks where the compartmental risk of $r_i$ is defined by a scaled relative supersaturation of tissue inert gas given by $$r_i = A_i \frac{P_{tisi} - P_{amb} - P_{thri}}{P_{amb}}, \text{ where } r_i \geqq 0.$$

17. A device as in claim 1 wherein the specified level of risk of decompression sickness is defined by a risk function where the risk is defined by a sum of compartmental risks where the first derivative of the compartmental risk of $r_i$ is defined by a scaled relative supersaturation of tissue inert gas given by $$\frac{dr_i}{dt} = A_i \frac{P_{tisi} - P_{amb} - P_{thri}}{P_{amb}}, \text{ where } r_i \geqq 0.$$

18. A device as in claim 1 wherein the specified level of risk of decompression sickness is defined by a risk function where the instantaneous risk depends upon partial pressure of inert gas in each "tissue" where the tissue partial pressure is defined by exponential kinetics given by $$\frac{dP_{ti}}{dt} = \frac{1}{\alpha_i}(P_a - P_{ti}).$$

19. A device as in claim 1 wherein the specified level of risk of decompression sickness is defined by a risk function where the instantaneous risk depends upon partial pressure of inert gas in each "tissue" where the tissue partial pressure follows exponential kinetics or linear kinetics as given by $$\frac{dP_{ti}}{dt} = \frac{1}{\alpha_i}(P_a - P_{ti}), \text{ if } P_{tisi} \leqq P_{amb} + P_{xoi}$$

$$\frac{dP_{ti}}{dt} = \frac{1}{\alpha_i}[P_a - (P_{amb} + P_{xoi}) + C\gamma],$$

if $P_{tisi} > P_{amb} + P_{xoi}$.

20. A device as in claim 1 wherein the optimal advice is comprised of a decompression profile that has the minimum time required for decompression from a higher to a lower pressure.

* * * * *